US008096220B2

(12) United States Patent
Weir et al.

(10) Patent No.: US 8,096,220 B2
(45) Date of Patent: Jan. 17, 2012

(54) MODULAR TABLE SAW GUARDING SYSTEM UPPER GUARD BARRIER

(75) Inventors: Alan Weir, Lake Zurich, IL (US); Gary Castaldo, Marengo, IL (US); Mark S. Talesky, Huntley, IL (US); Thomas R. Siwek, North Aurora, IL (US)

(73) Assignee: Robert Bosch GmbH, Stuttgart (DE)

( * ) Notice: Subject to any disclaimer, the term of this patent is extended or adjusted under 35 U.S.C. 154(b) by 541 days.

(21) Appl. No.: 11/890,891

(22) Filed: Aug. 8, 2007

(65) Prior Publication Data

US 2008/0022826 A1 Jan. 31, 2008

Related U.S. Application Data

(63) Continuation-in-part of application No. 11/284,214, filed on Nov. 21, 2005, now Pat. No. 7,437,981.

(51) Int. Cl.
*B27G 19/02* (2006.01)

(52) U.S. Cl. ..... 83/478; 83/477.2; 83/520

(58) Field of Classification Search ..... 83/520, 83/477.2, 102.1, 478
See application file for complete search history.

(56) References Cited

U.S. PATENT DOCUMENTS

| | | | |
|---|---|---|---|
| 713,196 | A | 11/1902 | Bennett |
| 1,258,961 | A | 3/1918 | Tattersall |
| 2,007,887 | A | 7/1935 | Tautz |
| 2,530,867 | A | 11/1950 | Galanga |
| 3,348,836 | A | 10/1967 | Smierciak |
| 3,566,934 | A | 3/1971 | Thrasher |
| 4,076,227 | A | 2/1978 | Rameson |
| 4,615,247 | A | 10/1986 | Berkeley |
| 4,625,604 | A | 12/1986 | Handler et al. |
| 4,721,023 | A | 1/1988 | Bartlett et al. |
| 4,805,505 | A | 2/1989 | Cantlin |
| 5,156,508 | A | 10/1992 | Grisley |
| 5,201,863 | A | 4/1993 | Peot |
| 5,235,752 | A | 8/1993 | Sauerwein |
| 5,287,779 | A | 2/1994 | Metzger, Jr. |
| 5,447,085 | A | 9/1995 | Gochnauer |

(Continued)

FOREIGN PATENT DOCUMENTS

| | | |
|---|---|---|
| DE | 910835 | 3/1954 |

(Continued)

OTHER PUBLICATIONS

Bosch 4000 Operating Instructions, 2007.

(Continued)

*Primary Examiner* — Stephen Choi
(74) *Attorney, Agent, or Firm* — Greer, Burns & Crain, Ltd.

(57) ABSTRACT

Embodiments are directed to a modular saw guard system for a power saw having a top and a vertically adjustable blade, the system comprises a riving knife mechanism, a blade guard mechanism that is releasably mounted to the riving knife mechanism when the riving knife mechanism is at least in its extended position, the blade guard mechanism generally covering the blade and being adjustable to enable a work piece to be moved into cutting position by the blade and a kickback prevention mechanism that is releasably mounted to the riving knife mechanism when the riving knife mechanism is at least in its extended position, the kickback prevention mechanism being configured to engage a work piece as it is being cut by the blade and apply resistance to prevent the work piece from being expelled in the reverse direction.

9 Claims, 20 Drawing Sheets

U.S. PATENT DOCUMENTS

| | | | | |
|---|---|---|---|---|
| 5,979,523 | A | 11/1999 | Puzio et al. | |
| 6,131,629 | A | 10/2000 | Puzio et al. | |
| 6,170,370 | B1 | 1/2001 | Sommerville | |
| 6,405,624 | B2 | 6/2002 | Sutton | |
| 6,502,809 | B1 | 1/2003 | Gionta | |
| 6,578,460 | B2 | 6/2003 | Sartori | |
| 6,644,157 | B2 | 11/2003 | Huang | |
| 6,736,042 | B2 | 5/2004 | Behne et al. | |
| 6,840,144 | B2 | 1/2005 | Huang | |
| 6,986,370 | B1 | 1/2006 | Schoene et al. | |
| 7,137,327 | B2 | 11/2006 | Garcia et al. | |
| 7,210,386 | B1 * | 5/2007 | Chang | 83/102.1 |
| 7,631,585 | B2 * | 12/2009 | Ichikawa et al. | 83/102.1 |
| 2001/0035081 | A1 | 11/2001 | Sutton | |
| 2002/0029822 | A1 | 3/2002 | Jukoff | |
| 2004/0103544 | A1 | 6/2004 | Hartmann | |
| 2004/0118261 | A1 | 6/2004 | Garcia et al. | |
| 2004/0255745 | A1 | 12/2004 | Poet et al. | |
| 2004/0261592 | A1 | 12/2004 | Chen | |
| 2005/0087049 | A1 | 4/2005 | Miller et al. | |
| 2005/0160895 | A1 | 7/2005 | Garcia | |
| 2005/0166736 | A1 | 8/2005 | Gass | |
| 2005/0188807 | A1 | 9/2005 | Parks | |
| 2005/0211034 | A1 | 9/2005 | Sasaki et al. | |
| 2006/0011034 | A1 | 1/2006 | Gehret et al. | |
| 2006/0042441 | A1 | 3/2006 | Ichikawa | |
| 2006/0096428 | A1 | 5/2006 | Garcia et al. | |
| 2006/0101962 | A1 | 5/2006 | Garcia | |
| 2007/0000366 | A1 * | 1/2007 | Peot et al. | 83/102.1 |
| 2007/0163408 | A1 * | 7/2007 | Buck et al. | 83/438 |
| 2007/0186739 | A1 * | 8/2007 | Peot et al. | 83/102.1 |

FOREIGN PATENT DOCUMENTS

| | | |
|---|---|---|
| DE | 917746 | 7/1954 |
| DE | 11 67 511 | 4/1964 |
| DE | 2364910 | 7/1975 |
| DE | 2917497 | 11/1980 |
| DE | 3137732 | 6/1983 |
| DE | 3315169 | 11/1983 |
| DE | 8807584 | 9/1988 |
| DE | 9306198 | 9/1993 |
| EP | 0012404 | 6/1980 |
| EP | 0605998 | 7/1994 |
| EP | 0633105 | 1/1995 |
| EP | 1491304 | 12/2004 |
| FR | 2239325 | 2/1975 |
| GB | 2273078 | 6/1994 |
| JP | 2005-262337 | 9/2005 |

OTHER PUBLICATIONS

"Elektra Beckurm®" TS 250 Operating Instructions, Metabo, Germany, pp. 14-23.

"Powermatic®" Model 2000 Operating Instructions and Parts Manual, WMH Tool Group, Revision B Apr. 2006. pp. 1-43.

"Powermatic®" Model 2000 Operating Instructions and Parts Manual, WMH Tool Group, Revision A Nov. 2005. pp. 1-43.

Roland Johnson, "10-in. Cabinet Saws", *Fine Woodworking*, May./Jun. 2006, pp. 46-51.

* cited by examiner

MODULAR TABLE SAW GUARDING SYSTEM UPPER GUARD BARRIER

This is a continuation-in-part of application entitled A MODULAR GUARD SYSTEM AND APPARATUS FOR A POWER SAW Ser. No. 11/284,214, filed Nov. 21, 2005 now U.S. Pat. No. 7,437,981 (74040).

BACKGROUND OF THE INVENTION

The present invention generally relates to power tools and, more particularly, to power table saws. Power table saws typically have guard systems that either attach to the undercarriage of the table saw, to the rear of the table saw or attached to some structure above the table saw. In each of these configurations there are typically three components, namely, a splitter or riving knife, kickback prevention devices, (often called kickback dawgs) and a blade guard that covers the blade. A riving knife is a safety device that reduces the likelihood of a kick-back event where a work piece is somehow caught or bound up during a cutting operation and the inertia of the blade throws the work piece back toward the user. A riving knife is typically considered to function similarly to a spreader or splitter on a blade guard assembly, but does not extend above the top of the blade.

With all known current commercial configurations, the user cannot separate these three components, which would be highly desirable depending upon particular circumstances, such as the type of cut that was being made.

There are two basic types of cuts that are generally made with a table saw and those are through cuts and non-through cuts. During a through cut the blade is protruding through the entire thickness of the work piece, and in this type of cut there are few problems with current table saw guard configurations. However, when making a non-through cut, the user must remove the guard system if the guard system is of the type which is attached to the undercarriage or the rear of the table saw. These two configurations are typically utilized on most portable and bench top models that are presently commercialized. Because there is a need to remove the guard system during non-through and other special types of cuts and because special wrenches or the like are often necessary, many users simply leave it off.

SUMMARY OF THE INVENTION

A preferred embodiment of the present invention is directed to a modular saw guard system for a power table saw of the type which has a table top, a rotatable circular saw blade that is vertically adjustable relative to the table top, the table top having an opening through which the saw blade can extend, the blade being configured to cut a work piece as the work piece is moved forwardly from a forward position to a rearward position, wherein the system comprises a riving knife mechanism mounted to the table saw rearwardly of the blade, and being configured to be adjustable between retracted and extended positions relative to the blade, a blade guard mechanism that is releasably mounted to the riving knife mechanism when the riving knife mechanism is at least in its extended position, the blade guard mechanism generally covering the blade and being adjustable to enable a work piece to be moved into cutting position by the blade and a kickback prevention mechanism that is releasably mounted to the riving knife mechanism when the riving knife mechanism is at least in its extended position, the kickback prevention mechanism being configured to engage a work piece as it is being cut by the blade and apply resistance to prevent the work piece from being expelled in the reverse direction.

Other embodiments are directed to apparatus that are components of the preferred embodiment of the system.

DETAILED DESCRIPTION

The preferred embodiment of the present invention comprises a modular guard system that has a riving knife mechanism, a blade guard mechanism and a kickback prevention mechanism, all of which can be either quickly adjusted, attached and/or removed. However, the riving knife mechanism must be attached to the table saw in a generally extended position if the blade guard mechanism or the kickback prevention mechanism is used, because these latter two mechanisms are attached to the riving knife mechanism.

With this type of modular configuration, the end user is more likely to use one or more of the guard system components as is necessary for a particular task being carried out on the table saw, rather than the typical choice a user now has, which is that of attaching or removing all of these components as part of a single guard system. While the illustrated embodiments of the present invention are shown in connection with a power table saw, it should be understood that the various quick release assemblies, as well as the mechanisms with which they are associated, can be utilized in other tools and environments, and that such other applications should be considered to be within the spirit and scope of the present invention. For example, embodiments of the present invention may be used with saws that are known as combo saws and flip saws that are marketed in Europe and possibly elsewhere.

While the modular design of the preferred embodiment of the present invention permits the removal of the riving knife mechanism, the blade guard mechanism and the kickback prevention mechanism, the design is not meant to encourage such removal. In fact, what is encouraged is the use of these mechanisms at all times. However, the reality of decades of historical use of table saws is that commercial artisans as well as experienced woodworkers want to and do use table saws to make specialty cuts, including plunge cuts, cove cuts and dado cuts, for example. A plunge cut can be made by placing a work piece on the saw with the blade retracted, turning on the motor and cranking the blade upwardly to make a cut more or less in the middle of the work piece. A dado cut is one made with a dado blade that makes a wide cut, and is often used to cut a slot in a work piece, i.e., a non-through cut. A cove cut is a specialty non-through cut, where a work piece is guided by a jig of some type to move the work piece across the blade at an angle (and cutting only an eighth of an inch depth or less per pass) thereby using the curvature of the blade to cut and make a concave surface in the work piece.

Figure 1:
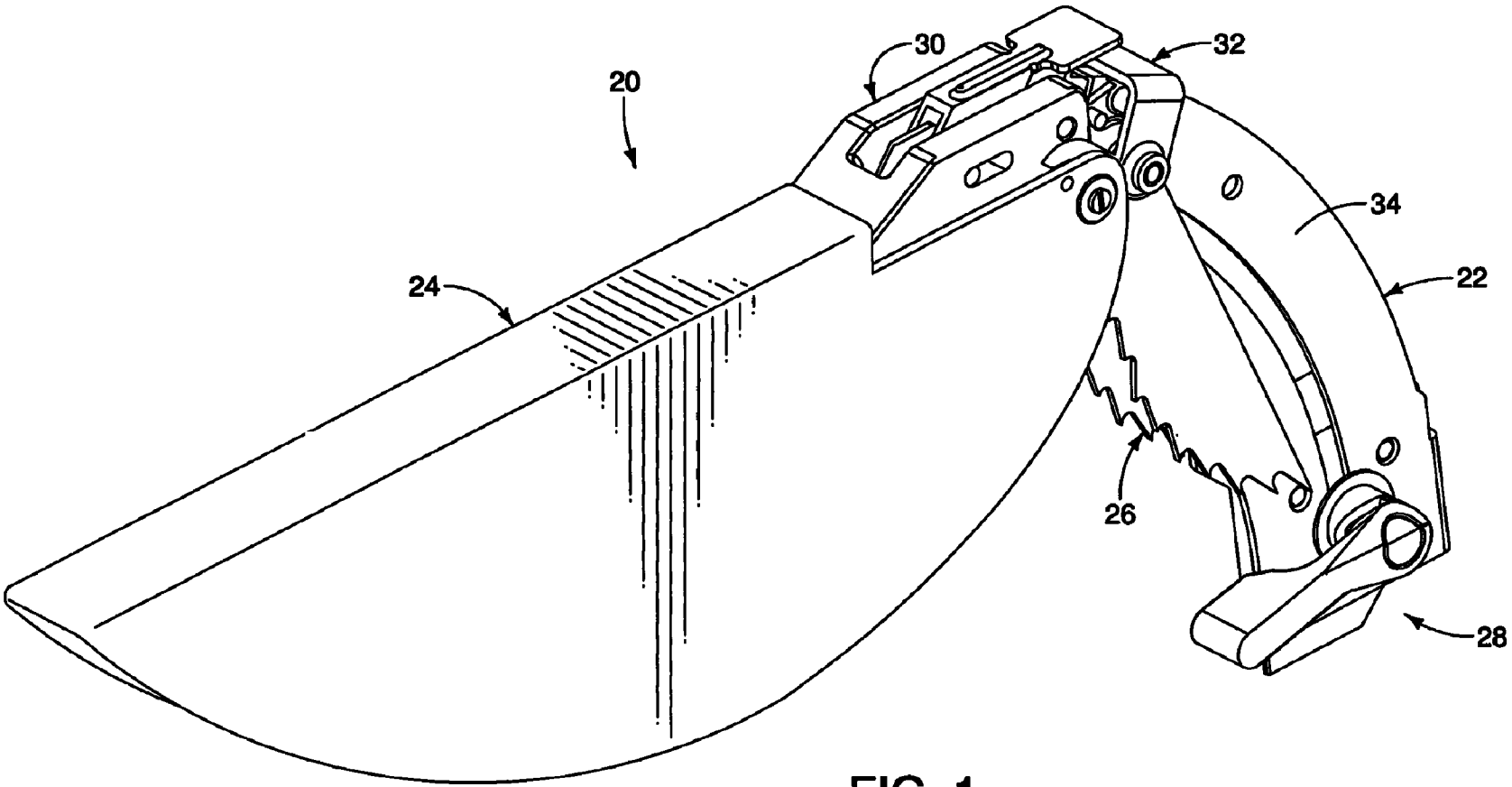
FIG. 1 is a perspective view of the preferred embodiment of a modular guard system of the present invention.

These specialty cuts cannot be made with known conventional riving knifes, blade guards and kickback dawgs being attached. Since commercial artisans and woodworkers remove them for such specialty tasks, the preferred embodiment of the present invention is configured to overcome many of the disadvantages of many conventional designs. One important feature is the elimination of the need to completely remove the riving knife mechanism to make any of the specialty cuts described above. If the blade guard mechanism and kickback prevention mechanism are detached from the riving knife, the riving knife can be easily retracted out of the way. After such specialty cuts are completed, the riving knife can then be easily adjusted to its extended position where the blade guard mechanism and kickback prevention mechanism can be quickly attached. Another benefit of the adjustable riving knife is that it maintains it alignment relative to the blade and therefore does not have to be realigned when it is adjusted to its extended positions Turning now to the drawings and particularly FIG. 1, there is shown a modular saw guard system, indicated generally at 20, that includes a riving knife mechanism, indicating generally at 22, a blade guard mechanism, indicated generally at 24, and a kickback prevention mechanism, indicated generally at 26. Each of these mechanisms has a quick release assembly, with the riving knife mechanism 22 having a riving knife quick release assembly indicated generally at 28, the blade guard mechanism having a blade guard quick release assembly indicated generally at 30, and the kickback prevention mechanism 26 having a kickback mechanism quick release assembly indicated generally at 32.

The blade guard mechanism 24, as well as the kickback prevention mechanism 26 are both mounted to the riving knife mechanism 22 and each can be separated from the riving knife mechanism quickly and easily by virtue of the quick release assemblies associated with these mechanisms. Similarly, the riving knife mechanism 22 can be quickly and easily adjusted on the table saw. Since the preferred embodiment of the riving knife mechanism can be adjusted among several positions, one of which is a fully retracted position that is below the table top, there is no need to remove it completely from the table saw. When the other mechanisms that are normally mounted to the riving knife mechanism are detached from the saw, the riving knife mechanism can be easily retracted and be completely out of view. This is a desirable feature, because it can be quickly and easily adjusted to one of its extended and intermediate positions. The convenience of this capability encourages the use of these safety features.

The riving knife mechanism 22 is adjustable by virtue of the quick release assembly 28 so that its elevation relative to the blade can be adjusted. More particularly, it can be positioned to any one of three elevations, including a retracted position where the top of the assembly is very close to or below the surface of the tabletop, a fully extended position and an intermediate position. In a fully extended position, the top of the riving knife mechanism 22 extends above the elevation of the top of the blade and is in the desired position where the blade guard mechanism 24 and the kickback prevention mechanism 26 can be mounted to the riving knife mechanism.

Figure 17:
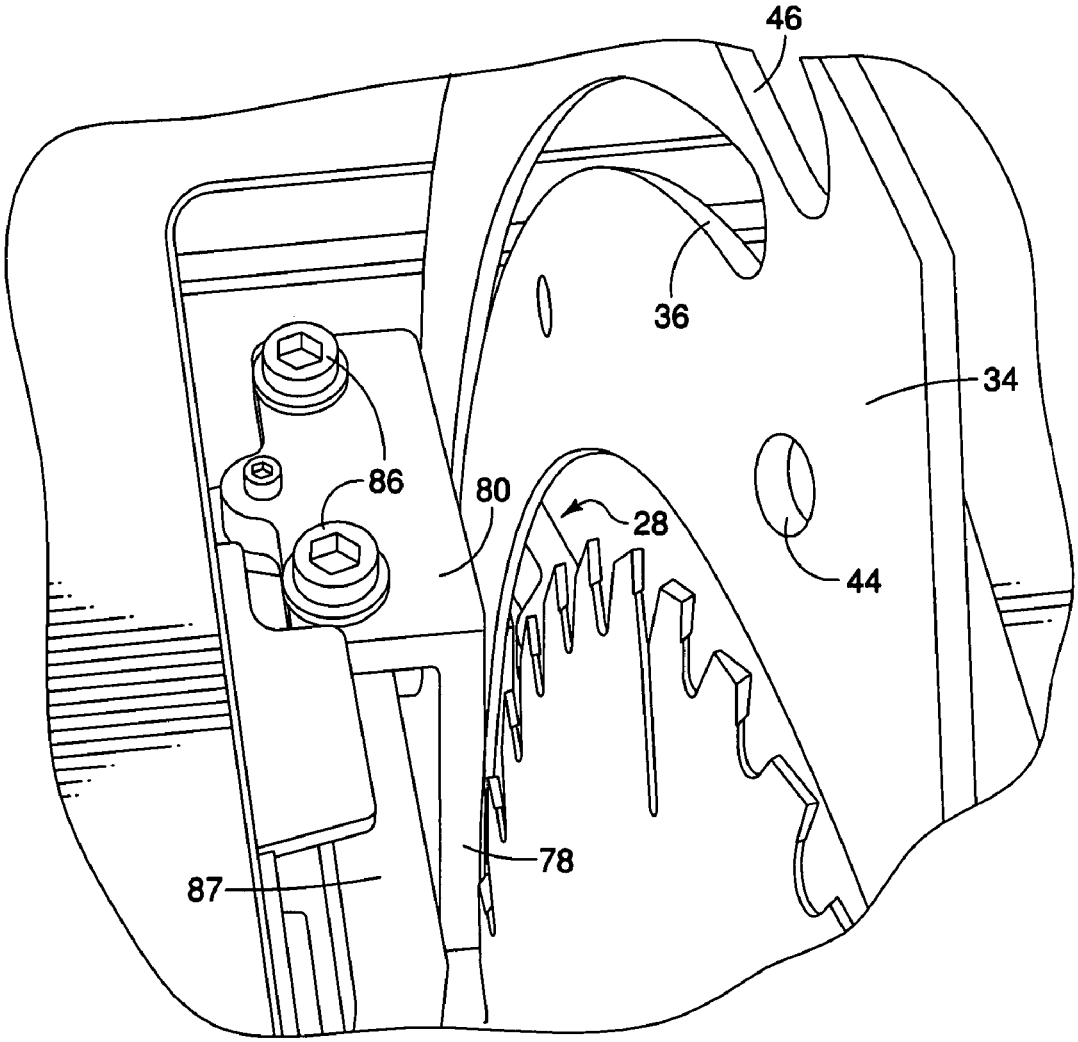
FIG. 17 is another perspective view of the riving knife mechanism portion of the apparatus shown in FIG. 1, particularly illustrating the riving knife mechanism illustrated as installed on the motor and arbor gear box assembly of a table saw.

The riving knife mechanism 22 can also be installed in an intermediate position that is generally midway between the retracted and fully extended position where it is operated as a conventional riving knife, as opposed to a separator or splitter. For this operating position, it is at a mid-mounting point and has the blade guard mechanism and the kickback prevention mechanism removed. In this position, the top of the riving knife is below the top edge or reach of the blade by a distance that is preferably between 3 and 5 millimeters. In this position, the user has the added security of the riving knife operating as a splitter which prevents the two cut work piece parts from closing on one another behind the blade which can bind the blade and create a kickback condition. It can also be used in the non-through cut mode where the top of the riving blade mechanism will penetrate into the partial cut line. In this regard, it should be understood that the riving knife mechanism 22 is mounted to a motor and arbor gear box assembly 87 (see FIG. 17) that drives the blade and is vertically as well as angularly adjustable. Since the elevation and angle of riving knife mechanism 22 changes as the motor and arbor gear box assembly 87 changes, the position of the riving knife mechanism 22 is constant relative to the blade.

As previously mentioned, when the riving knife mechanism is in its fully extended position, the blade guard mechanism 24 and kickback prevention mechanism 26 can be easily mounted to the riving knife mechanism 22. Alternatively, if better visualization is necessary, it is possible to remove the blade guard mechanism 24 and install the kickback prevention mechanism 26 to provide the security of having the splitter and the kickback prevention mechanism 26 be in an operational condition.

Figure 2:
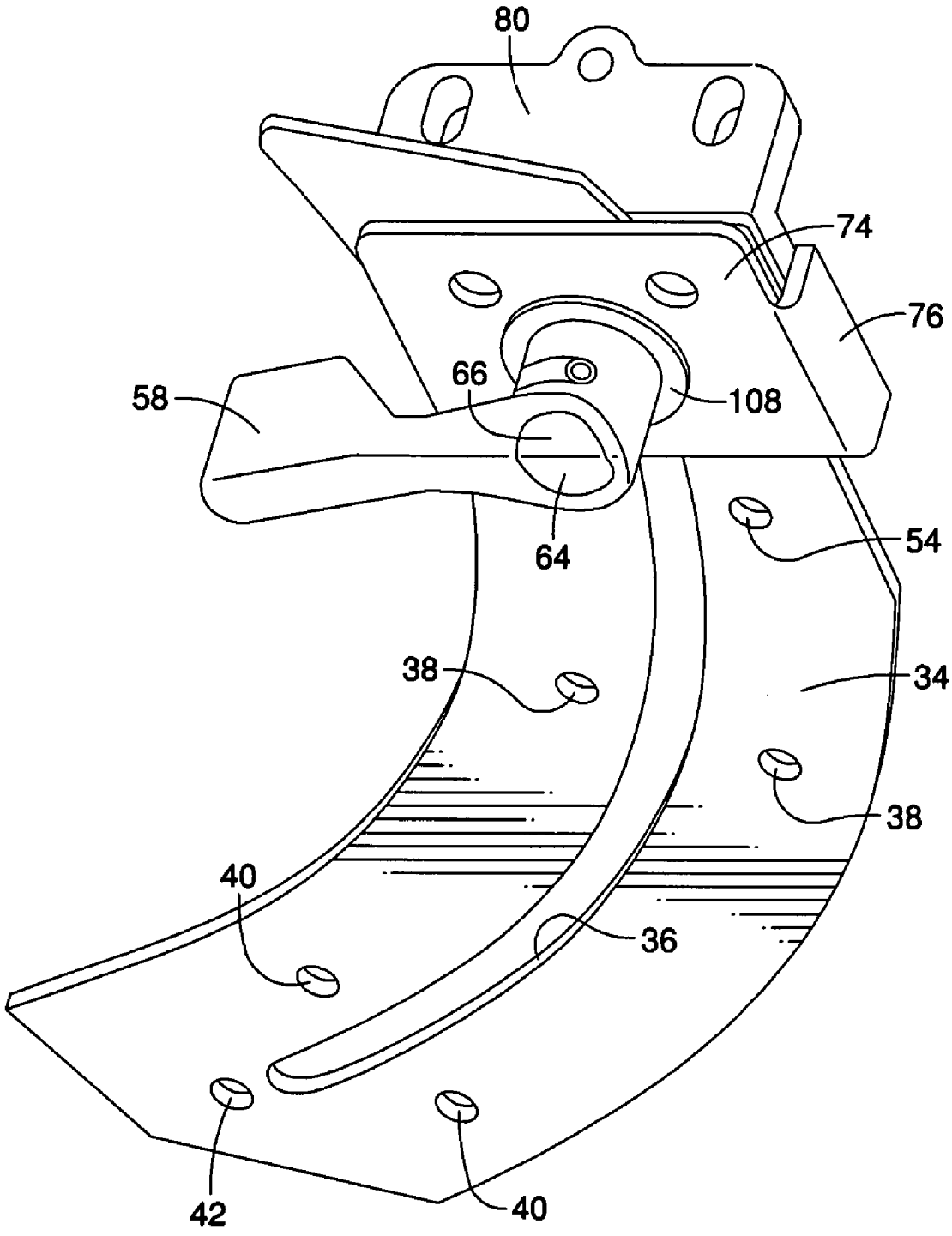
FIG. 2 is a perspective view of a portion of the system shown in FIG. 1, particularly illustrating a riving knife mechanism as shown in a retracted position wherein the top of the knife is positioned near or below the tabletop surface.
Figure 4:
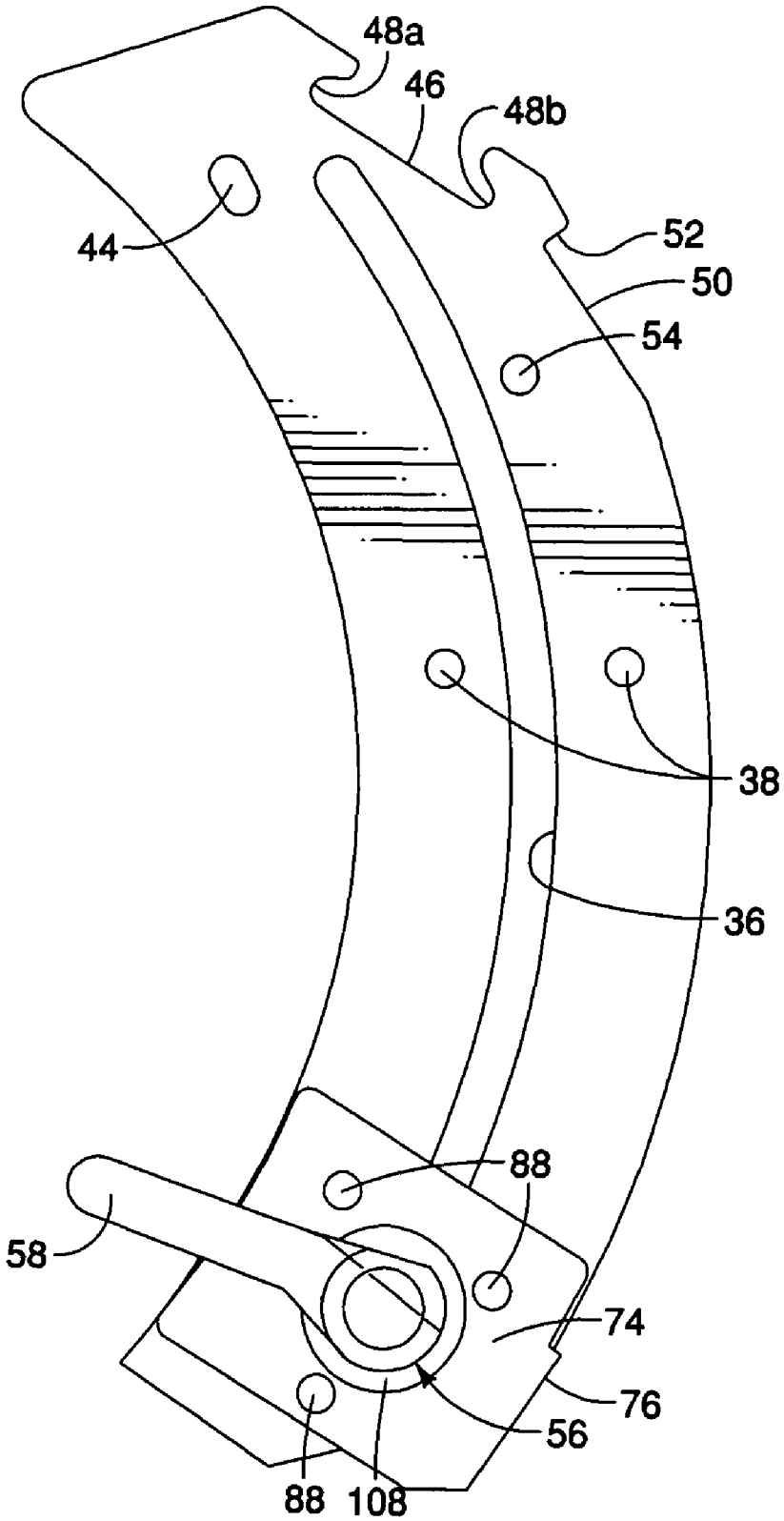
FIG. 4 is a side view of a portion of the riving knife mechanism shown in FIG. 2.

The riving knife mechanism 22 has an elongated generally curved thin knife 34 in addition to the quick release assembly 28. As best shown in FIGS. 2 and 4, the knife 34 is preferably a steel stamping and has a generally curved configuration with a center slot 36 that extends substantially the full length of the knife 34. There are a number of apertures 38 and 40 which are located on opposite sides of the slot 36, as well as an aperture 42 located generally in line with the slot 36 and positioned at the bottom of the knife 34. The apertures 38 are located generally midway between the ends of the knife 34.

As best shown in FIG. 4, an aperture 44 is located on the left side of the slot 36 and an elongated recess 46 is formed in the outer surface on the opposite side of the slot 36 with the recess 46 having a pair of spaced apart hook configurations 48*a* and 48*b* thereof which cooperate with the blade guard mechanism quick release assembly 30 to mount the blade guard mechanism 24 to the knife 34. Also, the outside surface adjacent the recess 46 contains a flat surface 50 that terminates in a shoulder 52 that cooperate with an aperture 54 for mounting the kickback prevention mechanism quick release assembly 32 to the knife 34.

Figure 5:
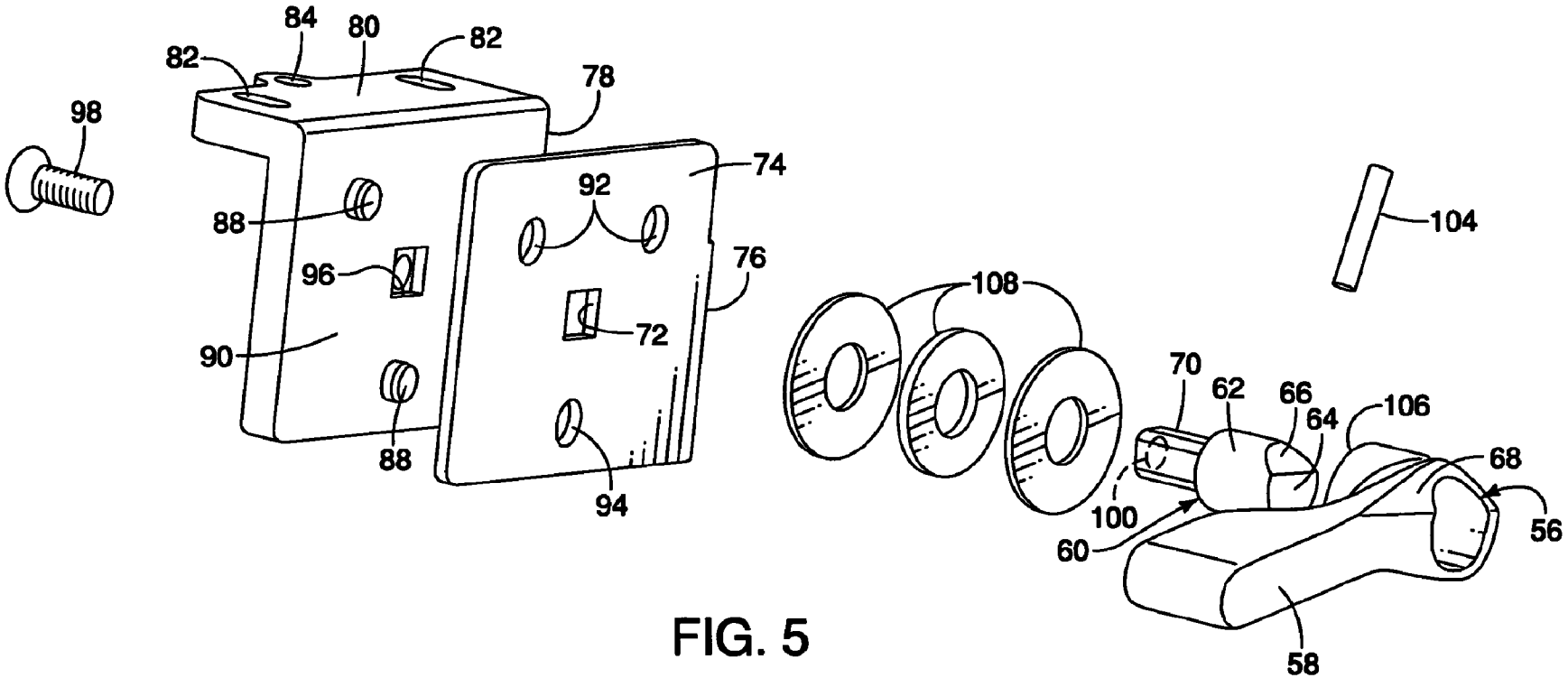
FIG. 5 is an exploded perspective view of a portion of the riving knife mechanism, particularly illustrating a quick release assembly for the riving knife mechanism.
Figure 6:
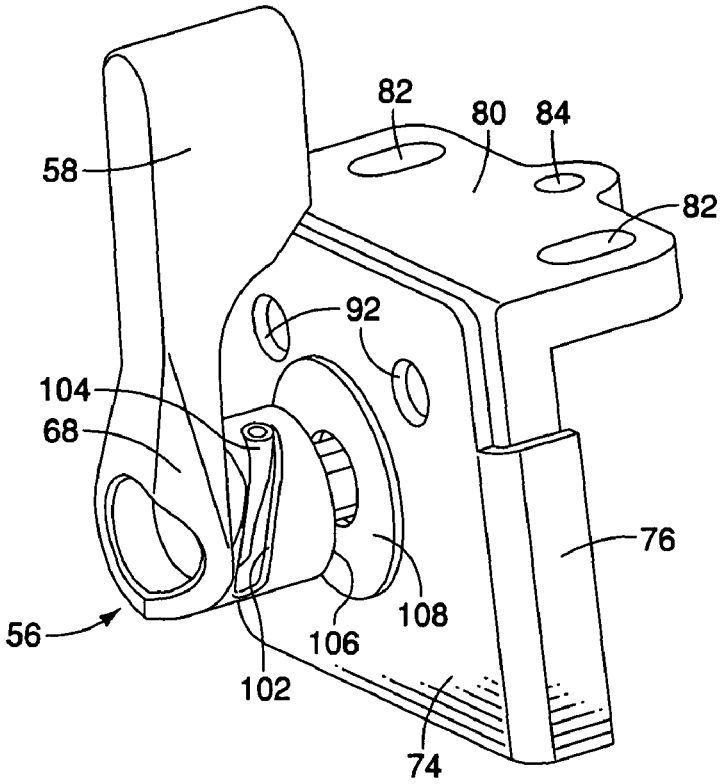
FIG. 6 is a perspective view of a portion of the quick release assembly shown in FIG. 5 and shown in the unlocked position.

With regard to the riving knife mechanism quick release assembly, it is shown in its locked position in FIGS. 2, 3, 4, 5 and 7 and in the unlocked position in FIG. 6. Referring initially to FIG. 5, the quick release assembly 28 comprises a lever 56 that has a handle portion 58, the lever 56 being mounted on a stud 60 and is rotatable as well as axially movable relative to the stud 60 between a locked position where the handle 58 is generally horizontal and an unlocked position where it is generally vertical, as is best shown in FIG. 6. The lever 56 preferably moves within the range of approximately 90 degrees to about 115 degrees between its locked and unlocked positions. The stud 60 has a large generally cylindrical portion with a flat end 64 and a generally 45° angled face portion 66 that is provided for the purpose of creating necessary clearance when the blade guard mechanism 24 is installed in a table saw. Similarly, a 45° flat face portion 68 is provided on the lever 56 for similar reasons. It should be understood that with different clearances, such face portions 66 and 68 may be unnecessary.

Figure 3:
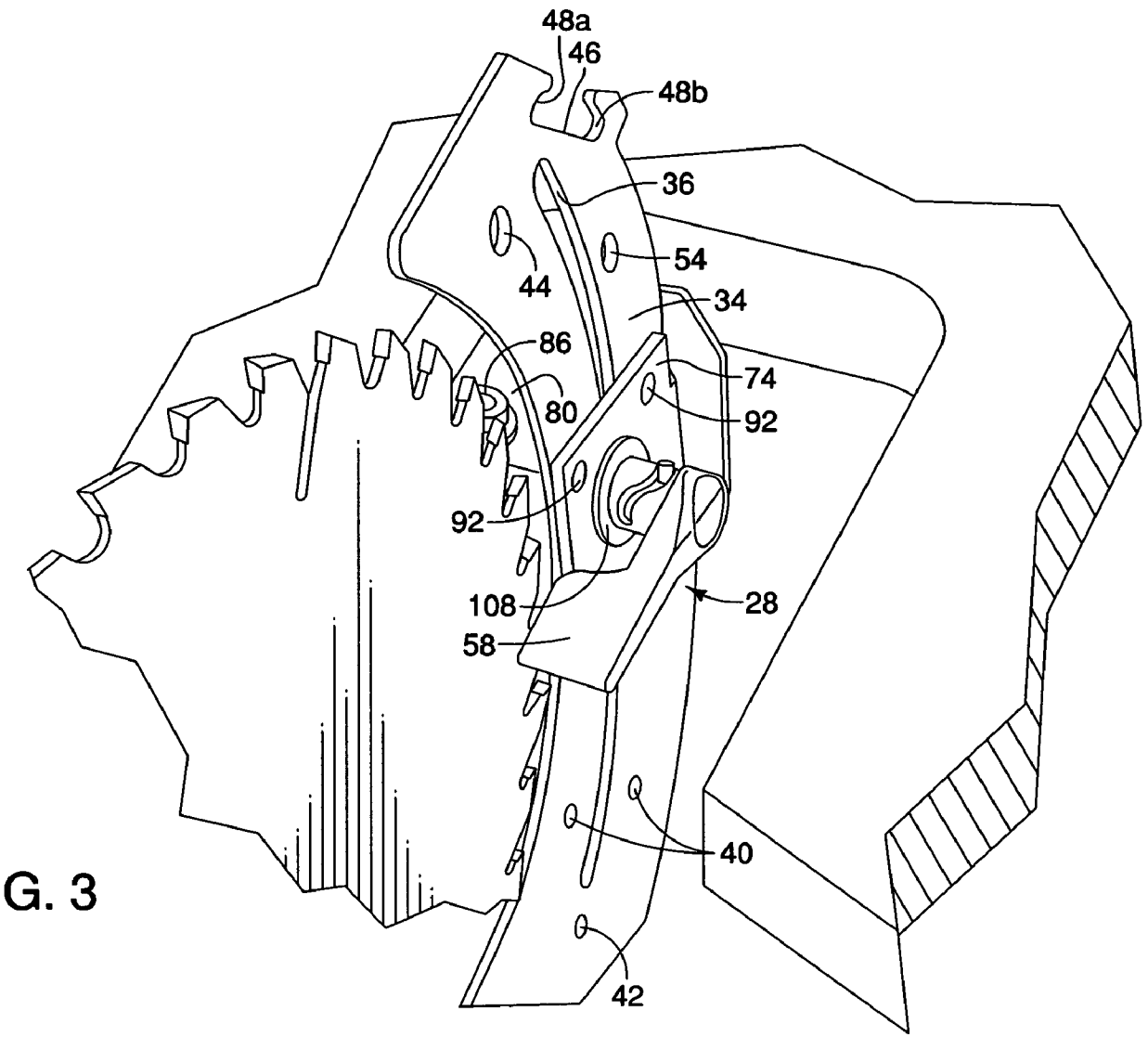
FIG. 3 is another perspective view of the riving knife mechanism portion of the apparatus shown in FIG. 1, particularly illustrating the riving knife mechanism illustrated as installed on a table saw.
Figure 7:
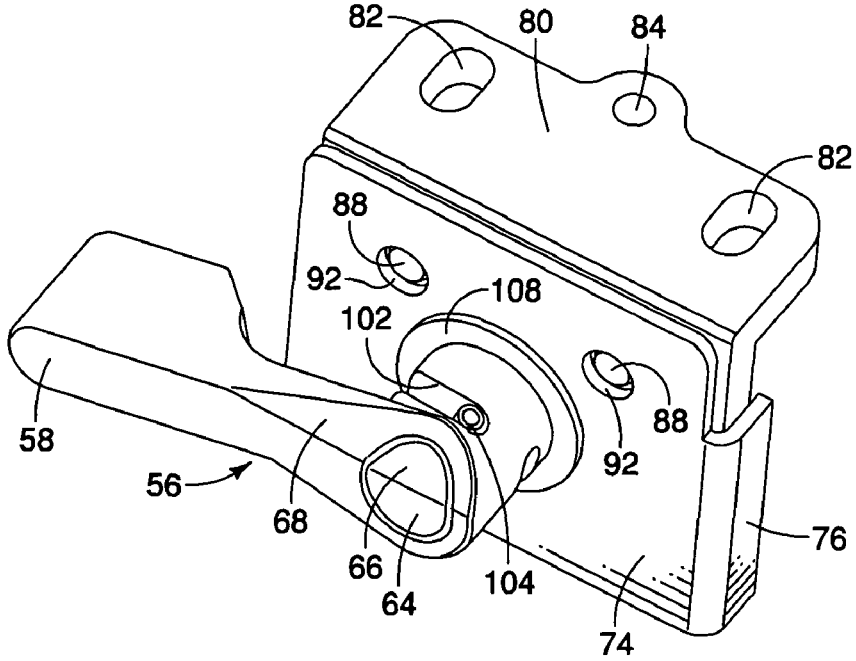
FIG. 7 is a perspective view of a portion of the quick release assembly shown in FIG. 5 and shown in the locked position.

The stud 60 has an extension 70 that has a generally square cross sectional configuration that engages a square aperture 72 in a plate member 74 that is positioned to contact the knife 34 as shown in FIG. 4, for example. It is also apparent from FIGS. 2 and 4 that the plate member 74 has a transverse extension 76 that is configured to abut the side of the knife 34 as well as the side of a bracket 78 as best shown in FIG. 7. The bracket 78 has an upper transverse extension 80 with apertures 82 and 84 for mounting the bracket to either the frame or the portion of the blade drive structure of the table saw. This is shown in FIG. 3 where the extension 80 is mounted to such structure by cap nuts 86.

The bracket 78 also has a number of relatively short pins 88 which extend from a front face 90 thereof. The front face contacts the knife 34 and the pins 88 are located on the front face 90 so that they can engage the apertures 38, 40 and 42 of the knife 34. In this regard, the plate member 74 also has apertures 92 and 94 that are configured to receive the pins 88 that extend through the apertures in the knife 34. Thus, when the bracket 78, knife 34 and plate member 74 are sandwiched together, the pins firmly hold the knife 34 in the desired position.

It should be apparent from FIGS. 2 and 5, that the knife 34 can be positioned in one of three positions, i.e., the lower position where the pattern of pins 88 penetrate the apertures 40 and 42, the mid position where the pins 88 penetrate the apertures 38 and the lower pin rides in the slot 36 and in the upper position where one of pins 88 penetrates the aperture 44 and another seats in the recess 46. The front face 90 of the bracket 78 also has a generally square aperture 96 through which a screw 98 passes.

The screw 98 is configured to fit through the aperture 96, the slot 36 of the knife 34, the aperture 72 and into a threaded aperture 100 in the extension 70 of the stud 60. The configuration of the stud extension 70 is slightly smaller than the size of the square apertures 72 and 96 so that the extension 70 will fit within them, but cannot rotate relative to the plate member 74 or the bracket 78. Therefore, the stud 60 is locked in position regardless of whether the quick release assembly 28 is in its locked or unlocked position.

It should also be understood that the length of the extension 70 is sufficient that the plate member 74 can move away from the knife 34 and the knife can move away from the bracket 78 a sufficient distance that the pins are disengaged from the apertures of the knife 34. This enables the elevation of the knife to be adjusted as desired.

However, the quick release mechanism 28 is configured to clamp the plate member 74 and knife 34 against the front face 90 of the bracket 78 when the quick release assembly is in its locked position. This is accomplished by the lever 56 having a cam surface 102 that extends approximately ¼ of a rotation between its locked and release position. A pin 104 is located in the cylindrical portion 62 and is sized so that it engages the sidewalls of the cam surfaces 102. While it is possible for a single cam surface to be used, a pair of opposed cam surfaces is preferred and is used to balance the forces that may be applied during operation. Since the pin 104 is secured to the stud 60 and the stud 60 is incapable of being rotated, as the lever 56 is rotated, it will cause its end face 106 to move toward and away from the plate 74 to lock it in place when it is in its generally horizontal position.

As shown in FIG. 3, the lever is positioned just below the surface of the table top when the motor, gear, and blade assembly is positioned in its upper most and un-beveled position, so that when a typical tabletop insert plate is removed (it is not present in FIG. 3), a user can readily access the lever 56 to rotate the same when it is desired to either remove or reposition the knife 34. The quick release assembly 28 also has a number of washers 108 to provide wear protection and ease of operation of the assembly 28.

Figure 8:
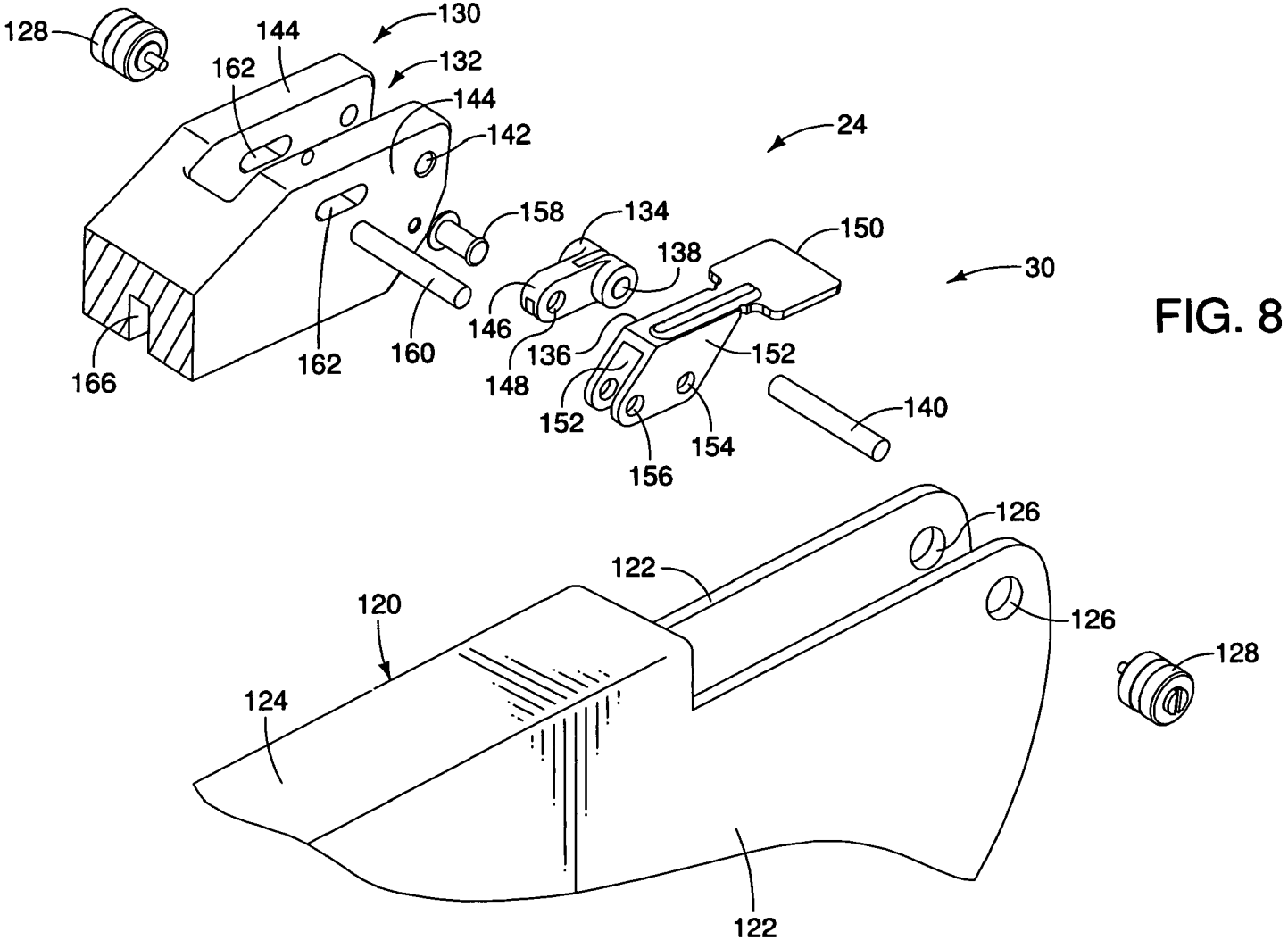
FIG. 8 is an exploded perspective of a blade guard mechanism portion of the system shown in FIG. 1.
Figure 9:
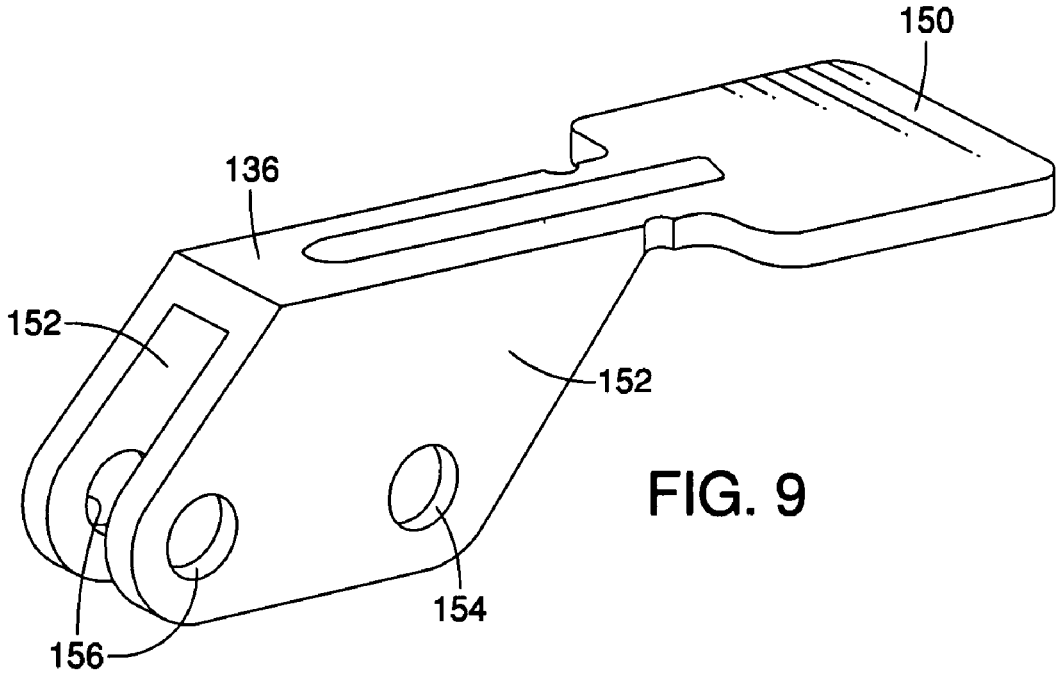
FIG. 9 is a perspective view of a portion of a quick release assembly for the blade guard mechanism shown in FIG. 8, and particularly illustrating an operating lever.

With regard to the blade guard mechanism 24, and referring initially to FIG. 8, it is shown in an exploded perspective which includes the blade guard mechanism quick release assembly 30, as well as a blade guard 120 that is configured to cover the blade of a table saw during operation. In this regard, the blade guard 120 has sidewalls 122 and a top portion 124, with the sidewalls having apertures 126 through which screws and a collar 128 are configured to pivotally mount the blade guard 120 to a mounting portion 130, with the screws 128 being inserted into apertures 142 on opposite sides of the mounting portion. While the blade guard 120 is shown to be a unitary structure, it should be understood that it could be two separate sidewalls and that rather than a top wall 124, the mounting portion 130 could have a forward extension that cooperates with the other components. Such a structure is intended to be within the scope of the present invention as are other blade guard configurations.

Figure 11:
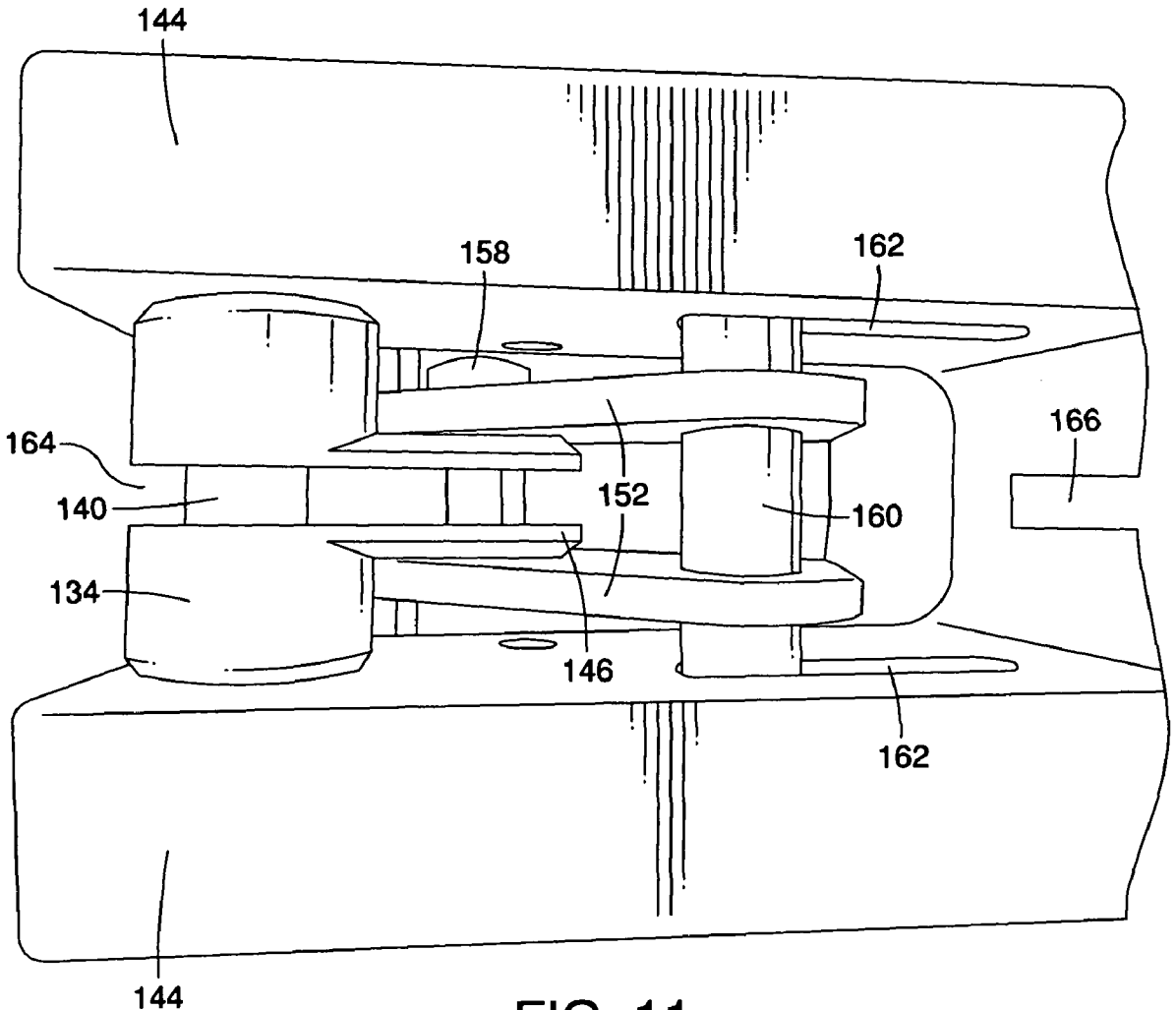
FIG. 11 is a plan view of a portion of the quick release assembly of the blade guard mechanism, particularly illustrating the lever and link with the lever being shown in the unlocked position.

The mounting portion 130 has a center channel 132 in which a link 134 and lever 136 are located. The link 134 has an aperture 138 in which a pin 140 is inserted, with the pin 140 also extending through apertures 142 in the mounting portion 130. Thus, the link 134 is pivotally attached to opposite sides 144 of the mounting portion 130. The link 134 has a narrower opposite end portion 146 in which an aperture 148 is located and the lever 136 has a lever handle 150 as well as two sidewalls 152 that are spaced apart from one another by a distance that is slightly greater than the width of the end extension 146. The sidewalls 152 contain apertures 154 and 156 for receiving pins 158 and 160, respectively, as well as an elongated horizontal slot 162 sized to receive the pin 160, which is slideable in it As shown in FIG. 11, the pin 160 slides in the slot 162, and when the assembly 30 is in its retracted or unlocked position, the handle 150 of the lever 136 is elevated which causes the end 146 of the link to also be elevated and simultaneously move the outer end of the lever 136 where the pin 160 is located in the apertures 156 to move to the right as shown in FIG. 8 and to the left as shown in FIG. 11. This enables the pin 160 to be retracted from the hook configuration 48*a* of the recess 46 of the knife 34 (see FIG. 4, for example). The opposite pin 140 located in the other hook configuration 48*b*. When the mounting portion is positioned on the knife 34 with the pin 140 engaging the hook 48*b* and the lever 150 is pushed down so that it is in a generally horizontal position, the pin 160 will move in the slot 162 away from the pin 140 and engage the hook 48*a* to hold the blade assembly to the knife 34.

Figure 10:
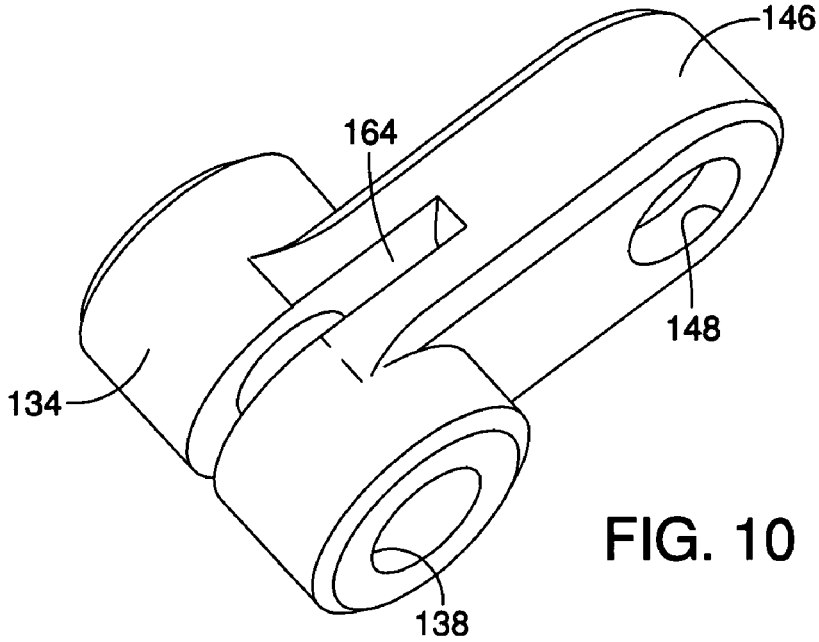
FIG. 10 is a perspective view of a portion of a quick release assembly for the blade guard mechanism shown in FIG. 8, and particularly illustrating a link.

As is best shown in FIG. 10, the larger end of the link 134 has a transverse slot 164 that has a width that is slightly larger than the thickness of the knife 34 on which the link 134 is positioned when the blade guard mechanism 24 is attached to the knife 34. Similarly, the mounting portion 130 has a slot 166 which enables the mounting portion to also fit on the blade 34. The slots 164 and 166 (see FIGS. 8 and 11) thereby hold the blade guard from rocking from side to side when it is attached to the knife 34. It should be appreciated that the pin 140 is exposed in the slot 164 when the blade guard mechanism 24 is attached to the knife 34, and the pin 140 has a diameter that generally conforms to the curvature of the hook 48*b* and the pin 160 also has a diameter that generally conforms to the curvature of the hook 48*a* of the knife 34.

Figure 12:
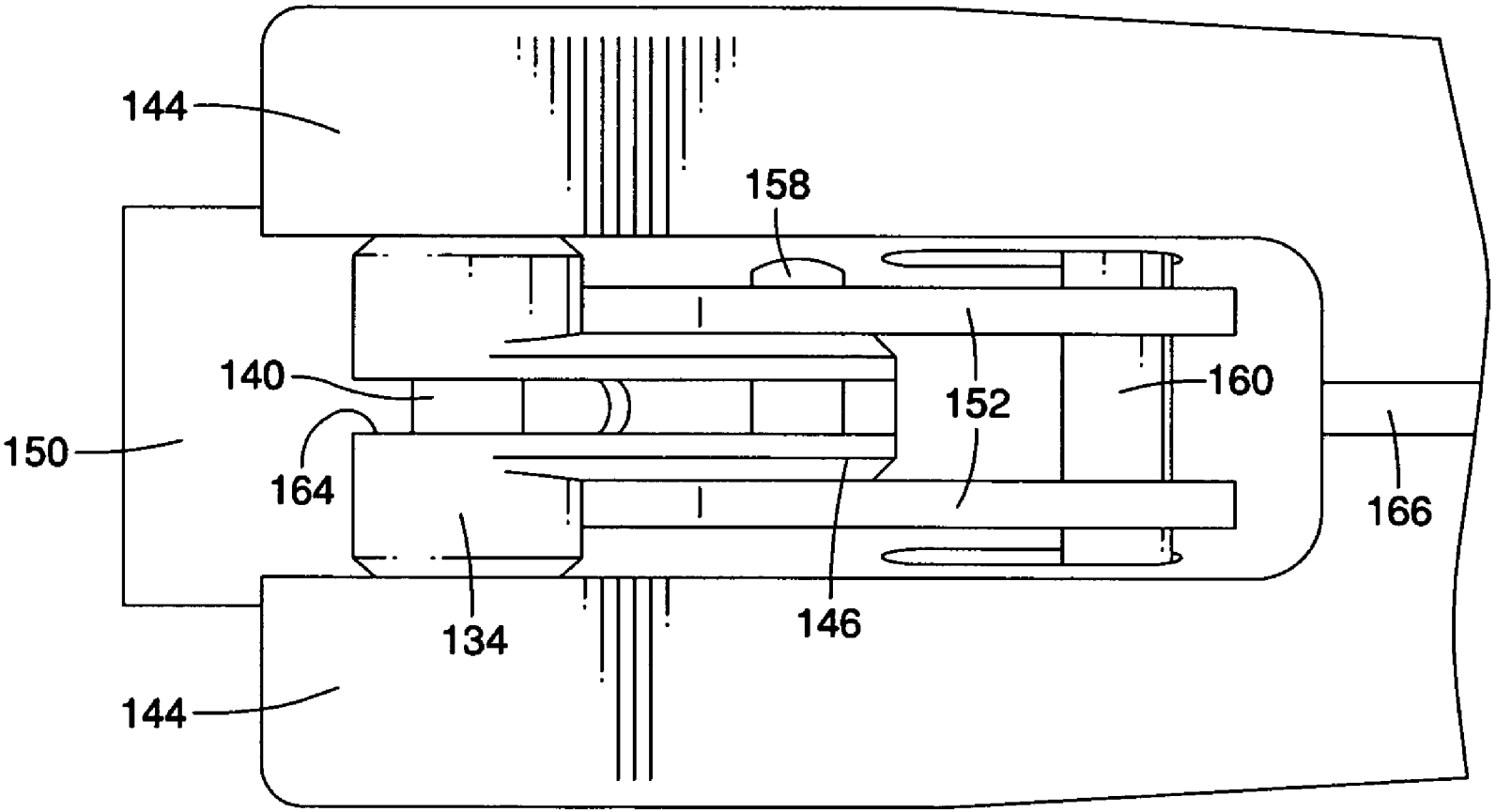
FIG. 12 is a plan view of a portion of the quick release assembly of the blade guard mechanism, particularly illustrating the lever and link with the lever being shown in the locked position.

The view of the link 134 and lever 150 are shown in the retracted or unlocked position in FIG. 11 and in the locked position in FIG. 12. It is preferred that the distance between the pins 160 and 140 when in the locked position apply at least a minimal amount of force to the opposite hook configurations 48*a* and 48*b* so that the mechanism will exhibit a force tending to hold the mechanism in its locked position. The design creates a lock action via an over-center camming action between the link 134 and the lever 150. When the three points that comprise these parts are in a straight line, they are in compression. Furthermore when the lever 150 forces the middle point below the center point, it reaches an equilibrium that is held in place by a combination of gravity and the compressive force on the link 134 and the lever 150. However, it should be understood that when the blade guard is locked, gravity has no effect on the assembly, but when the mechanism is in the unlocked position gravity holds the guard 24 to the knife 34.

Figure 19:
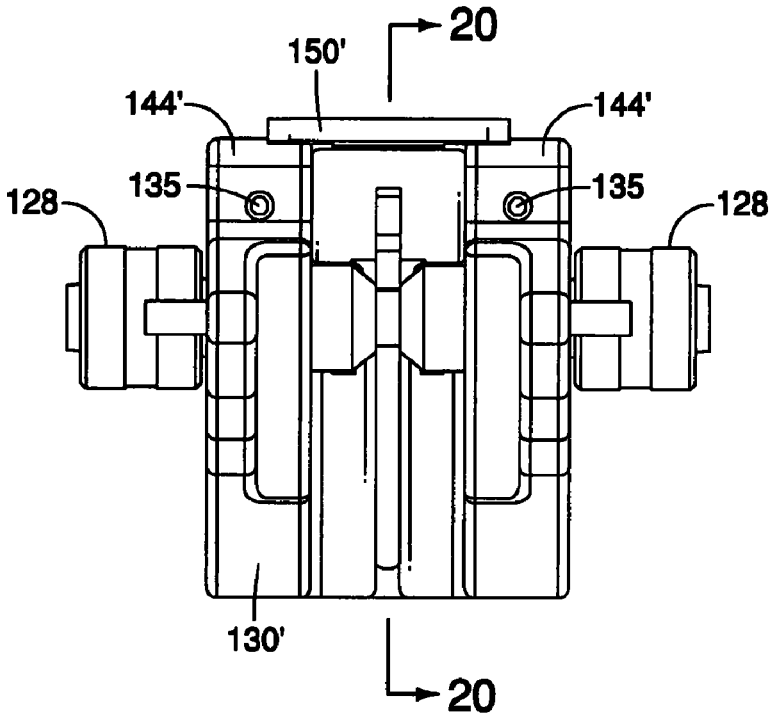
FIG. 19 is an end view of a portion of an alternative embodiment of a quick release assembly of the blade guard mechanism, particularly illustrating the lever and link with the lever being shown in the locked position.
Figure 20:
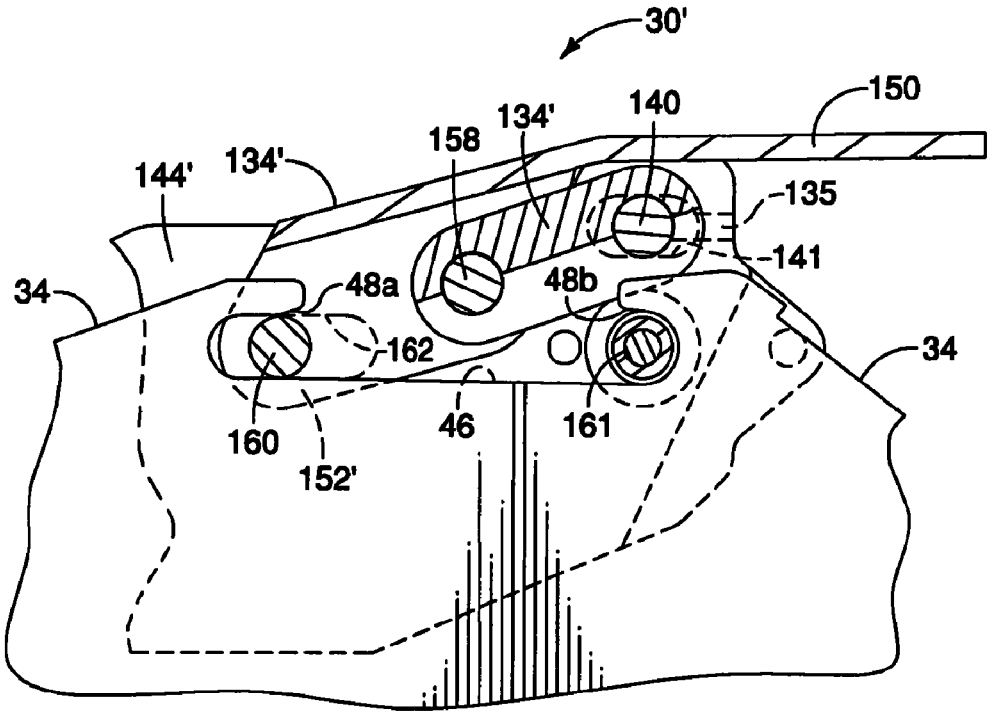
FIG. 20 is a cross section taken generally along the line 20-20 in FIG. 19.

An alternative embodiment of the quick release assembly 30' is shown in FIGS. 19 and 20, which illustrates components that have similar shapes as having the same reference numbers and a prime designation. Thus, the above description with regard to the quick release assembly 30 has applicability to the alternative embodiment. The alternative embodiment enables the assembly 30' to be adjusted so that reliable locking via an over-center camming action between the link 134' and the lever 150' can be achieved even with less stringent manufacturing tolerances. This is achieved by having the pin 140 riding in an elongated slot 141 and being adjustable to effectively vary the length of the link 134' and outer end of the lever 136'. This is done by varying the depth of a pair of set screws 135 that are threaded in apertures in opposite sides 144' of the mounting portion 130'. Thus, by rotating the set screws 135, the pin 140 can be moved in the slot to cause the pin 160 to be moved relative to the hook configuration 48*a* of the blade 34. This embodiment has another pin 161 that is mounted between side portions 144 located below pin 140, and this pin 161 is inserted into the recess 46 and engages the hook configuration 48*b*. By having this additional pin 161 engaging the hook configuration 48*b*, adjustment of the pin 140 effectively changes the distance between pins 160 and 161 when the handle 150' is in its locked position as shown, enabling reliable locking action to be achieved.

Figure 13:
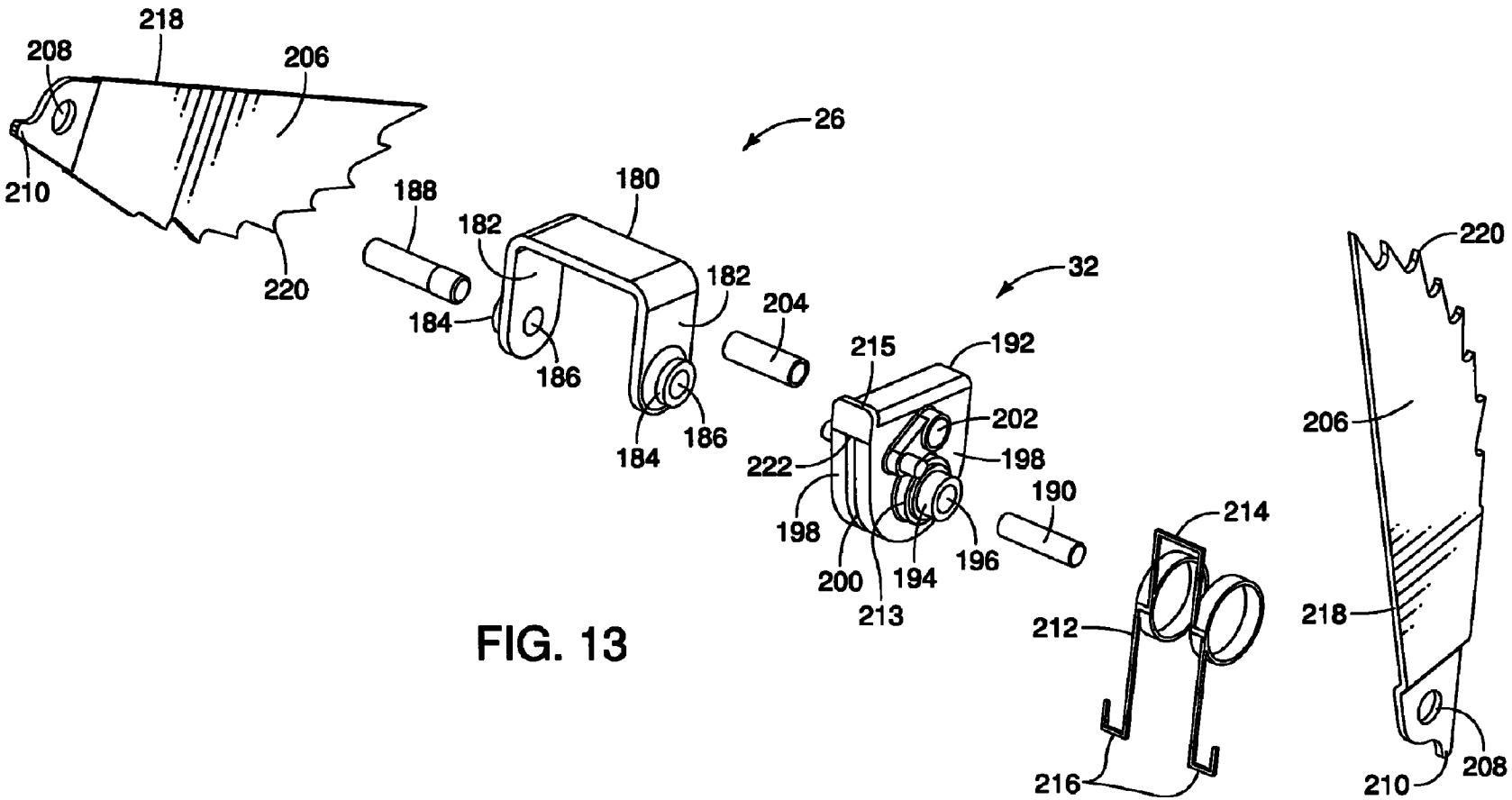
FIG. 13 is an exploded perspective view of the kickback prevention mechanism of the system shown in FIG. 1.
Figure 14:
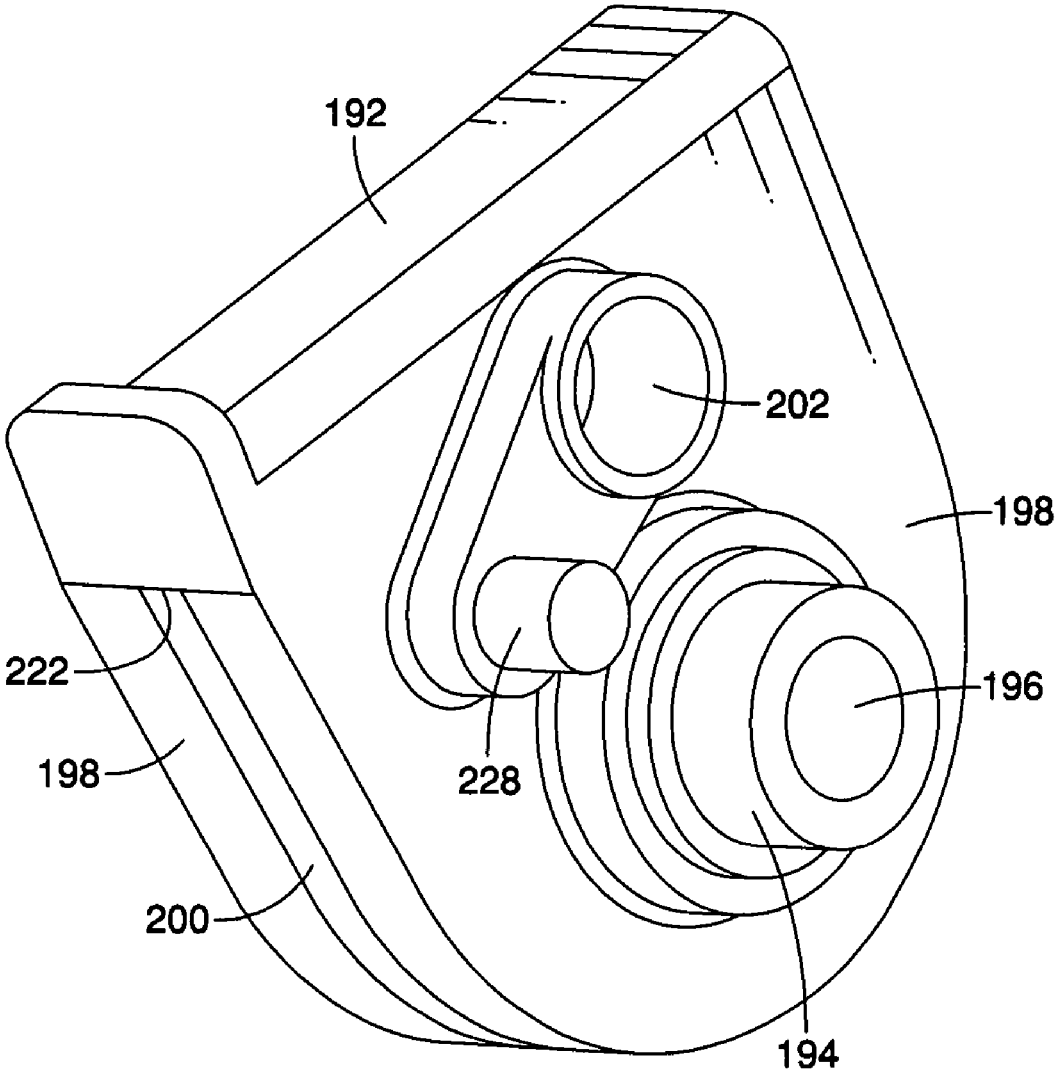
FIG. 14 is a perspective view of a portion of the kickback prevention mechanism and particularly illustrating a latch body thereof.

Turning now to the kickback prevention mechanism 26 and referring to FIG. 13 which is an exploded perspective of the mechanism, the mechanism includes a bracket 180 that has transverse leg portions 182 that have cylindrical support sleeves 184 that have apertures 186 for receiving a pair of pivot shafts 188 and 190. The pivot shafts 188 and 190 are preferably solid steel and are force fit and tightly secured in the apertures 186, with the left shaft 188 being slightly longer than the shaft 190. A mounting latch body 192 also shown in FIG. 14 has a pair of cylindrical extensions 194 on opposite sides thereof, each of which has an aperture 196 therein, with the size of the aperture 196 being slightly larger than the diameter of the pivot shafts 188 and 190 so that the latch body 192 can slide on the pivot shafts 188 and 190.

The latch body 192 has side walls 198 and a narrow slot 200 located between them. The slot 200 shown in either FIG. 13 or the enlarged similar view shown in FIG. 14 actually extends the entire distance from the front to the rear. The latch body also has a pocket 202 in which one end of a compression spring 204 is placed. The mechanism has a pair of elongated kickback arms 206 which have an aperture 208 on one end thereof together with an end ear 210 that extends away from the aperture 208 that is configured to engage an extension 211 to limit the movement of the arm 206 in the downward direction when attached to the knife 34. The apertures 208 of the arms 206 are sized to fit on the cylindrical portions 194.

A torsion spring 212 is provided and fits around enlarged cylindrical portions 213 and has a center bridge portion 214 that bears against a shoulder 215 on the top of the latch body 192, and a pair of outer ends 216 that bear against a back edge 218 of the arms 206. The opposite side of the arms has a number of serrated points 220 that are configured to engage a work piece in the event that it is kicked back in the reverse direction during a cutting operation which could cause injury to the user of the table saw. Since a kickback event is extremely dangerous and can apply a substantial force on the work piece, the pivot shafts 188 are preferably sized to withstand a substantial force and therefore are approximately ¼" in diameter and made of solid hardened steel.

Figure 16:
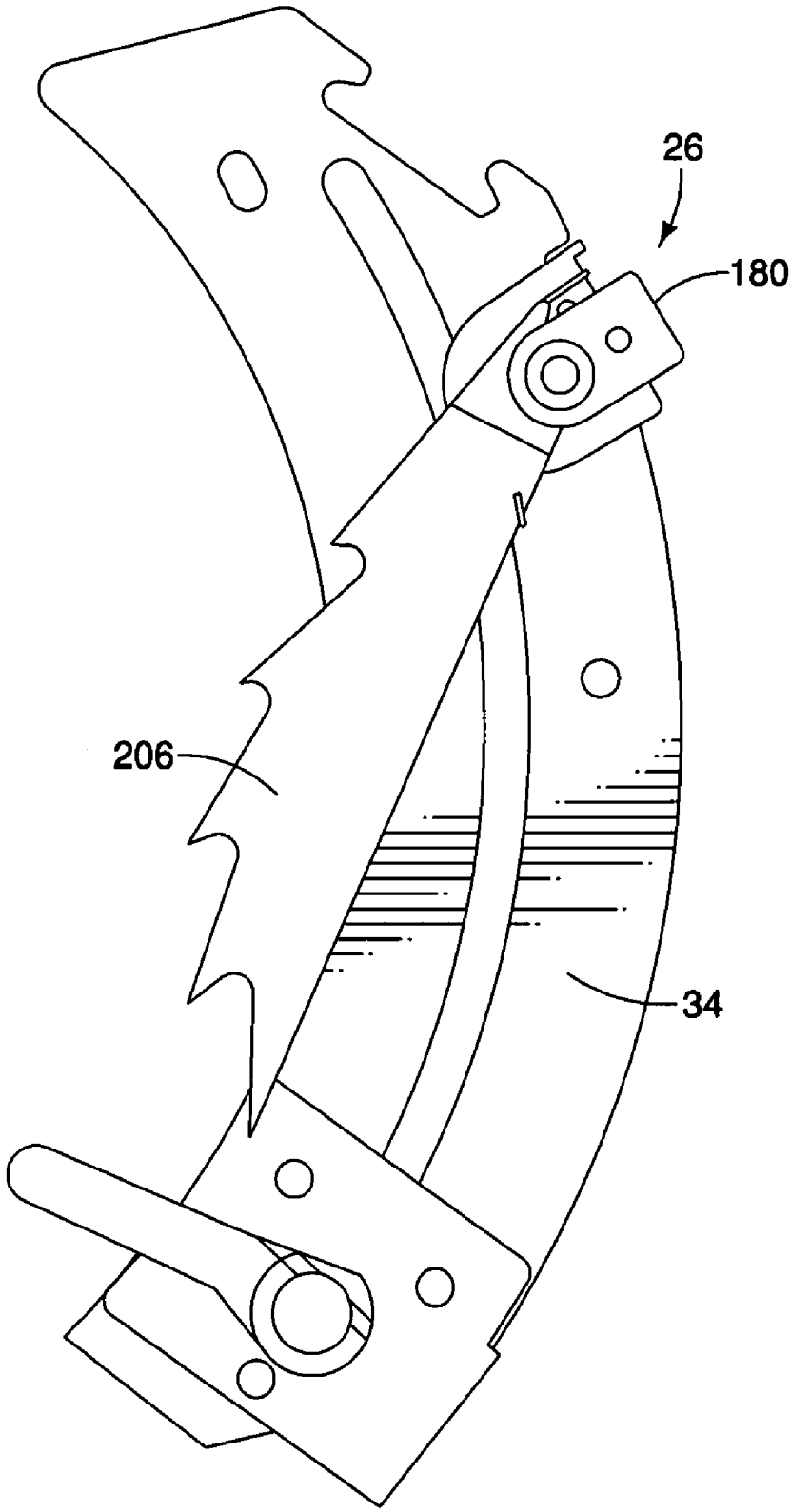
FIG. 16 is a plan view of the kickback prevention mechanism attached to the riving knife mechanism.

As shown in FIG. 16, the kickback prevention mechanism 26 sits on and is mounted upon the knife 34 and has a quick release assembly 32 that generally comprises the latch body 192 in combination with the pivot shafts 188 and 190 in connection with the bracket 180. The slot 200 has a width that is slightly greater than the thickness of the knife 34 and top face 222 of the slot 200 is preferably straight and extends from front to rear so that it will engage the flat surface 50 and shoulder 52 of the knife 34 as shown in FIGS. 4 and 16.

Figure 15:
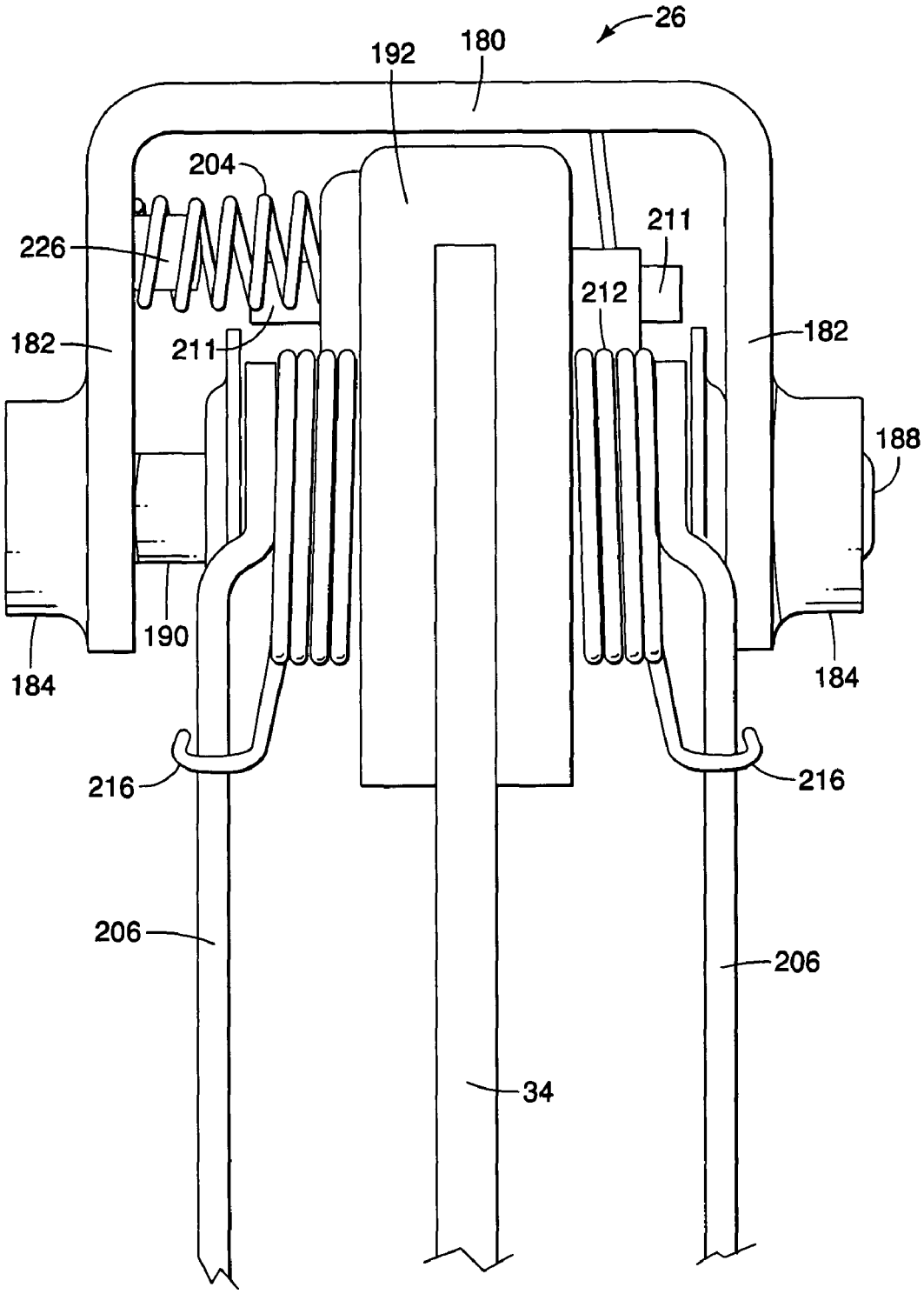
FIG. 15 is an end view of the kickback prevention mechanism shown in FIG. 13.

As shown in FIG. 4, the aperture 54 is provided adjacent the flat surface 50 and is sized and configured to receive the pivot shaft 188 when it is locked in position. As is best shown in FIG. 15, a compression spring 204 is provided and has one end retained by an extension 226 located on the inside of the leg portion 182 as shown in FIG. 15 with the opposite end seated in the pocket 202 preferably formed on the latch body 192. Since the latch body is slideable on the pivot shafts 188 and 190, the compression spring 224 forces the latch body to the right as shown in FIG. 15 which maintains the kickback prevention mechanism quick release assembly 32 in its locked condition.

Figure 18:
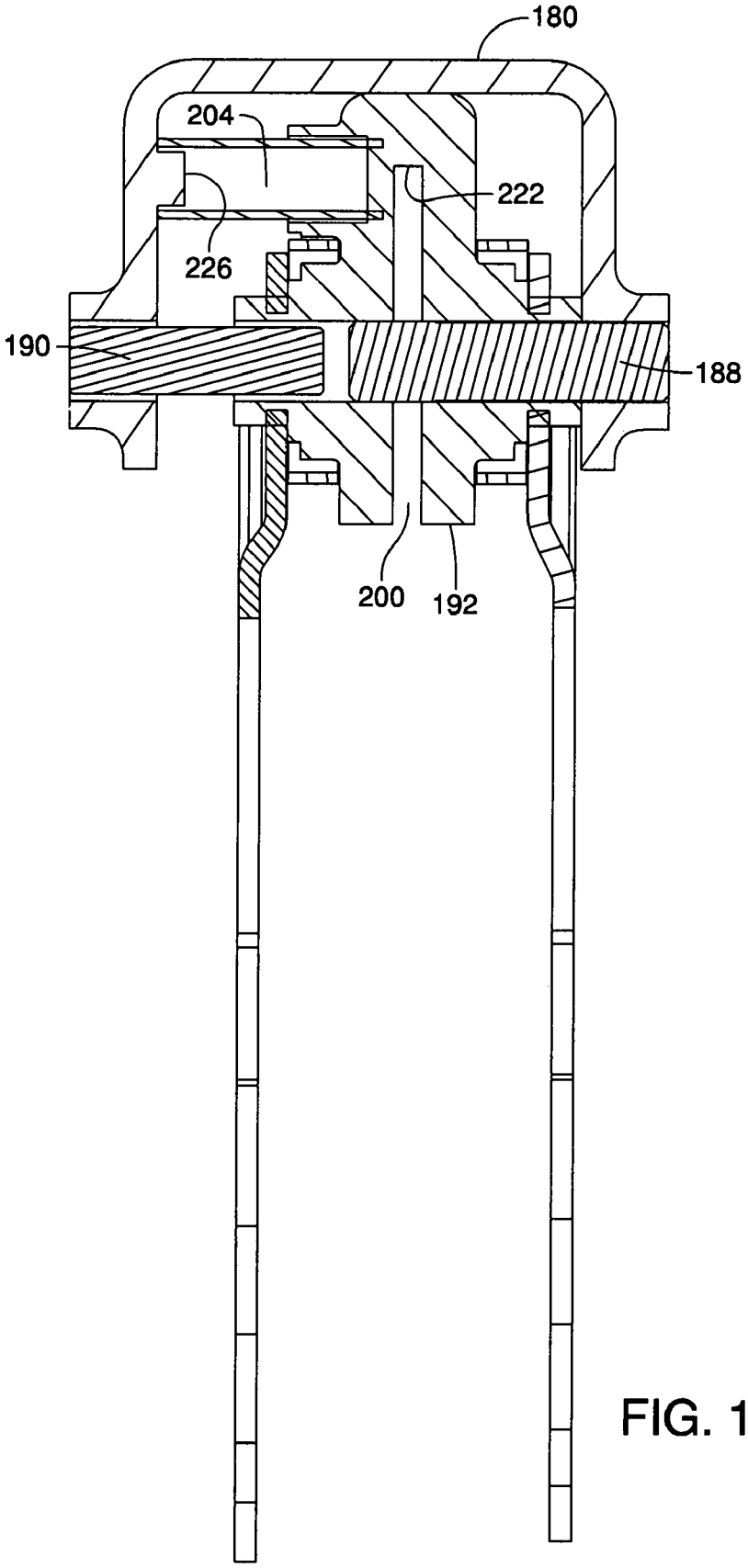
FIG. 18 is a cross section of a portion of the kickback prevention mechanism shown in FIG. 13.

To attach or remove the kickback prevention mechanism 26 from the knife 34, the user needs to push the latch body 192' to the left relative to the bracket 180 as shown in FIGS. 15 and 18. When this is done, the latch body slot 200 moves relative to the pivot shaft 188 so that the shaft 188 is disengaged from the aperture 54 in the knife 34, enabling the latch body 192 and therefore the kickback prevention mechanism 26 to be lifted from the knife 34. It should be appreciated that the views of FIGS. 15 and 18 are from the rear while the view of FIG. 13 is from the right front. The foregoing description is made from the perspective of FIGS. 15 and 18.

Figure 21:
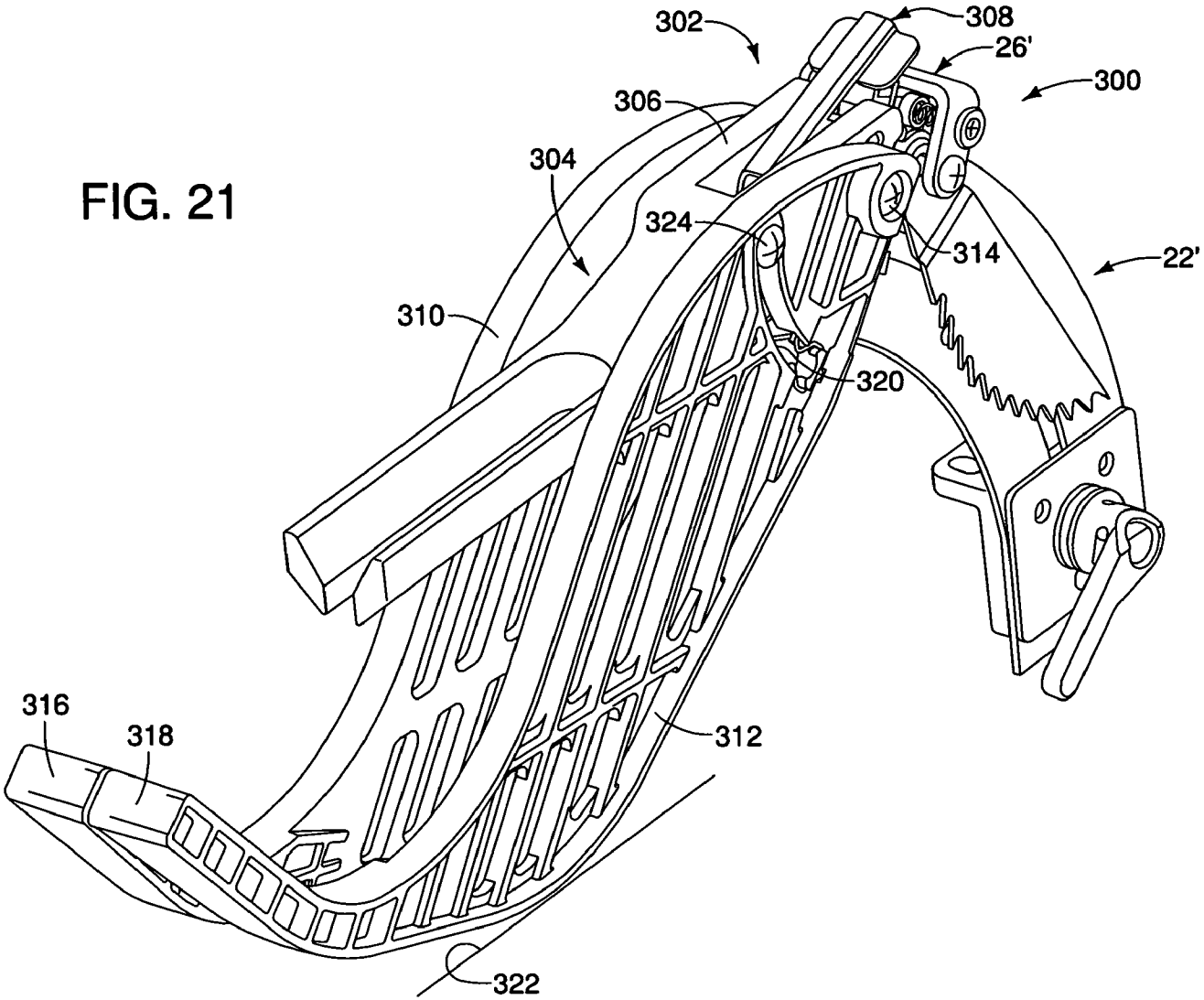
FIG. 21 is a perspective view of an alternative preferred embodiment of a modular guard system of the present invention.
Figure 22:
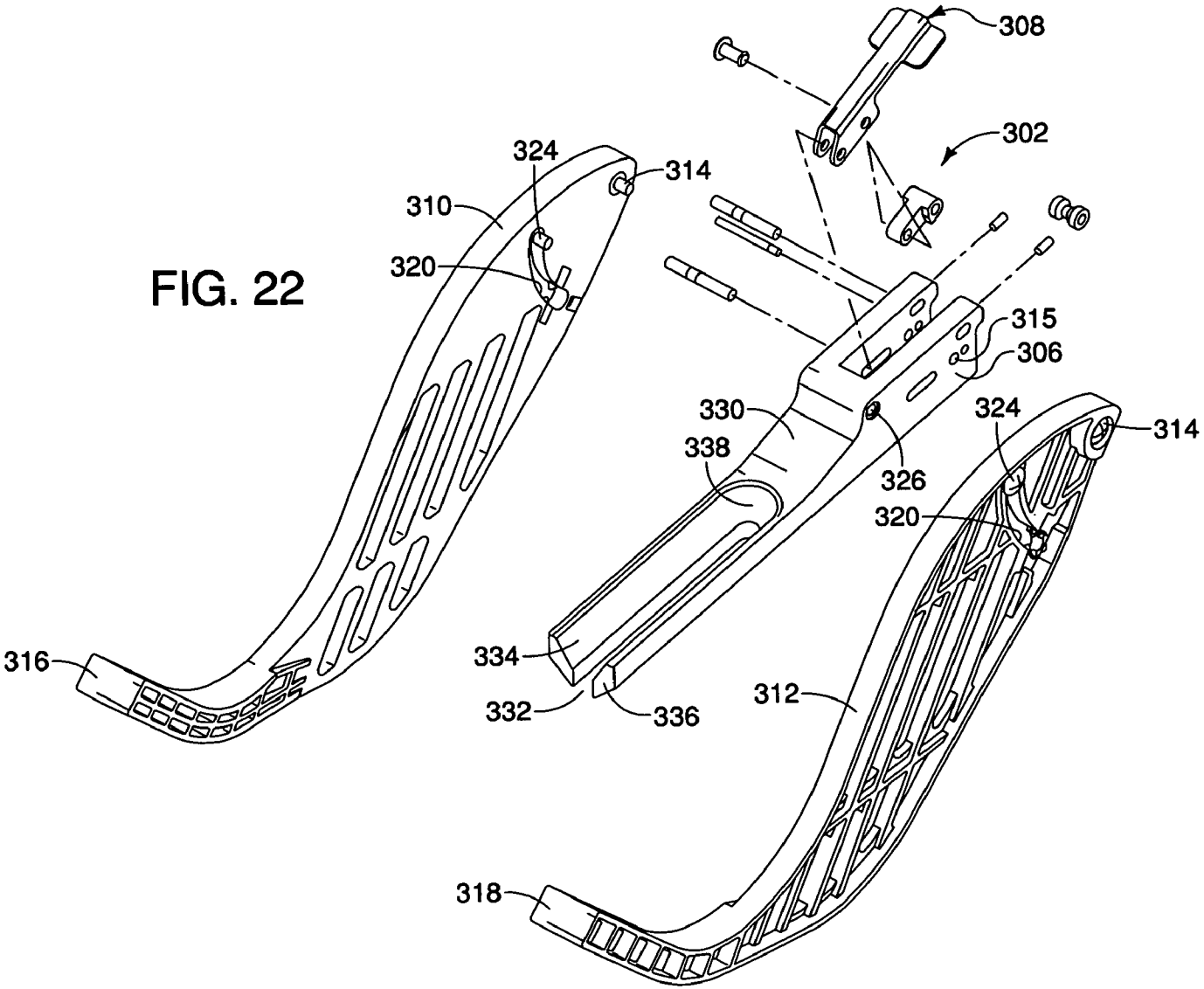
FIG. 22 is an exploded perspective view of the embodiment shown in FIG. 21.
Figure 23:
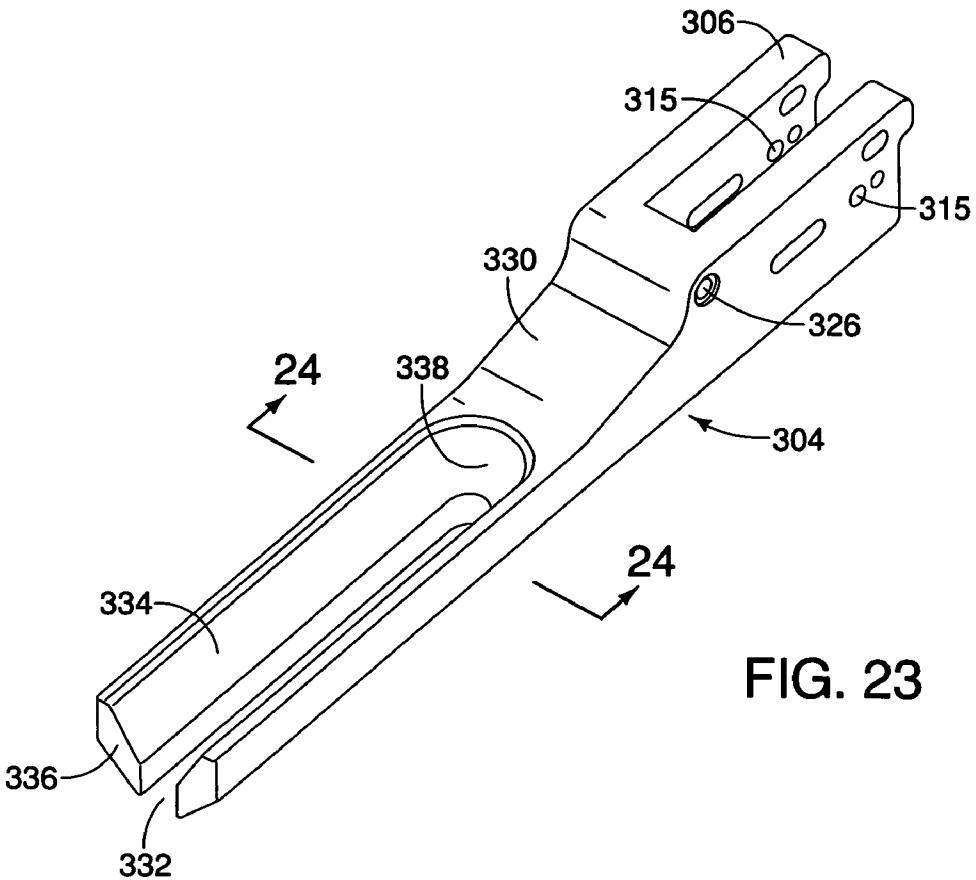
FIG. 23 is a perspective view of the upper guard barrier component of the embodiment shown in FIG. 21.

A further embodiment of a blade guard system is indicated generally at 300 in FIGS. 21 and 22 and includes a riving knife mechanism 22' which is substantially similar to the riving knife mechanism 22 previously described, a kickback prevention mechanism 26' that is substantially similar to the kickback prevention mechanism 26 previously described, as well as a blade guard mechanism, indicated generally at 302.

The blade guard mechanism 302 comprises an upper guard barrier, indicated generally at 304, which includes a mounting portion 306 that includes a quick release mechanism, indicated generally at 308; that is substantially similar to the quick release mechanism 30' that is shown in FIGS. 19 and 20 and described herein.

The modular guard system 302 also includes a pair of side barriers 310 and 312 which are attached to the mounting portion 306 by large headed screws 314. The screws 314 are screwed into apertures 315 located on each side of the mounting portion 306. The side barriers 310 and 312 pivot around the attachment screws 314 which enables the side barriers to lift up generally from the position as shown in FIGS. 21 and 22 when a work piece is pushed into position to be cut by a saw blade that is located between the side barriers. The front end portions 316 and 318 are upwardly flared to lift the side barriers when they engage a work piece which would generally be moving left to right as shown in FIGS. 21 and 22.

These side barriers 310 and 312 each have an arcuate slot 320 that is provided to limit the rotational movement of the side barriers from the downward or lowermost position shown in FIG. 21 where the bottom of the side barriers engages the top surface of a saw as is diagrammatically illustrated by line 322. A second screw 324 is provided for each side barrier with the screws 324 engaging apertures 326 on each side of the mounting portion 306. The second screws 324 also have an enlarged head that contacts the outer surface of the side barriers 310 and 312 adjacent the slot 320 and provides additional structural support for the side barriers to prevent their being inadvertently damaged. The stress caused by sideward forces applied to either of the side barriers that would otherwise be borne solely by the pivot connection on the screws 314 is shared by the second screw 324.

The upper guard barrier 304 has a fork-like mid and forward portion 330 that has a viewing slot 332 that is formed in approximately the front half of the total length of the upper guard barrier 304. It is noted that the viewing slot 332 is located at the end of the barrier near the forward reach of the blade which is where a user would want to view the initial engagement with a work piece during a cutting operation.

The barrier 304 is preferably cast of metal, such as steel, aluminum or any other structurally sound material so that it will be strong and have an extended useful life. The viewing slot 332 is formed by the top surface 334 being slanted downwardly to the slot 332 which is shown to have generally vertical side walls at its lower portion. The downwardly slanted surface 334 extends from the outer end 336 to the inner curved portion 338 and provides an enhanced view of the blade by an operator viewing from different angles.

Figure 24:
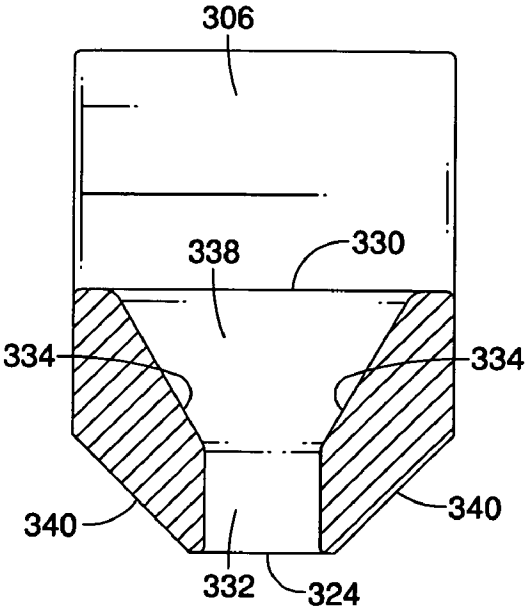
FIG. 24 is a cross section taken generally along the line 24-24 in FIG. 23.

It should be understood that the blade guard mechanism 302 is constructed so that the viewing slot 332 is centered as shown in FIG. 24 and the blade is also centered so that the plane of the blade is generally centered with the slot 332. With the angled sides 334 forming a generally V-shaped opening, the optical viewing angles to a user is significantly increased even though the width of the slot 332 is not very wide. In this regard, the width of the slot is preferably not appreciably much wider than a few thicknesses of a blade, i.e., the width of the slot may be approximately ⅜" as compared to a blade thickness of approximately ⅛".

The bottom surfaces 340 are also sloped upwardly from the elevation 342 defined by the bottom of the mounting portion 306. The configuration of these bottom surfaces 340 helps to funnel debris such as wood cuttings and sawdust away from the user during cutting by a blade. While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A modular saw guard system for a power saw of the type which has a table top with a table top surface, a rotatable circular saw blade that is vertically adjustable relative to the table top, the table top having an opening through which the saw blade can extend, the blade being configured to cut a work piece as the work piece is moved from a forward position to a rearward position, said system comprising:

a riving knife mounted to the saw rearwardly of the blade;

a blade guard mechanism that is releasably mounted to said riving knife and being configured to cover the blade and be adjustable to enable a work piece to be moved into cutting position by the blade;

said blade guard mechanism having an elongated upper guard barrier that extends from a portion that connects to said riving knife forwardly above the blade, said upper guard barrier having a top surface facing away from the table top surface, a bottom surface facing toward the table top surface and outer side surfaces extending between said top and bottom surfaces, said upper guard barrier having a viewing slot substantially coextensive with the blade, with a major portion of said top surface of said upper guard barrier adjacent said viewing slot being downwardly angled from said top surface near said outer side surfaces toward a center of said viewing slot to enlarge the viewing angle of said blade from above by a user, said bottom surface of said upper guard barrier adjacent said viewing slot extending upwardly away from said viewing slot and the table top surface to deflect work piece cuttings away from said viewing slot;

wherein said viewing slot extends perpendicularly relative to said table top surface between a lower most point of said upwardly extending bottom surface and a lower most point of said downwardly angled top surface of said upper guard barrier.

2. A modular saw guard system as defined in claim 1 wherein said viewing slot extends from said portion that connects to said riving knife forwardly to an outer free end of said upper guard barrier.

3. A modular saw guard system for a power saw of the type which has a table top, a rotatable circular saw blade that is vertically adjustable relative to the table top, the table top having an opening through which the saw blade can extend, the blade being configured to cut a work piece as the work piece is moved from a forward position to a rearward position, said system comprising:

a riving knife mounted to the saw rearwardly of the blade;

a blade guard mechanism that is releasably mounted to said riving knife and being configured to cover the blade and be adjustable to enable a work piece to be moved into cutting position by the blade;

said blade guard mechanism having an elongated upper guard barrier that extends from a portion that connects to said riving knife forwardly above the blade, said upper guard barrier having a viewing slot substantially coextensive with the blade, with a top surface of said upper guard barrier being downwardly angled toward both sides of said viewing slot to enlarge the viewing angle of said blade from above by a user, said viewing slot extending from said portion that connects to said riving knife forwardly to an outer free end of said upper guard barrier;

wherein said blade guard mechanism further comprises a quick release assembly that attaches to said riving knife, said quick release assembly being mounted to said upper guard barrier and having a lever that is movable between a release position and a holding position, said blade guard mechanism being removable from said riving knife when said lever is in its release position;

said quick release assembly further comprises a central channel defining spaced side portions, each having a horizontal slot therein, a link having a first end in said channel pivotally mounted to said side portions by a first pin and a second end pivotally mounted to a center portion of said lever by a second pin, said lever having a first end gripping portion for operating said lever and a second end portion connected to a third pin that rides in said at least one slot, said lever having a center slot that exposes said third pin and said link having a center slot at its first end exposing said first pin, said third pin engaging a first hook configuration in said riving knife to hold said blade guard to said riving knife when said lever is in its holding position, each of said side portions having an aperture for receiving an adjusting member that bears against said first pin of said link to calibrate the position thereof to minimize movement of said upper guard barrier relative to said riving knife when said blade guard mechanism is attached to said riving knife.

4. A modular saw guard system as defined in claim 3 wherein said upper guard barrier is made of metal.

5. A modular saw guard system as defined in claim 4 wherein said upper guard barrier is cast of steel or aluminum.

6. A modular saw guard system for a power saw of the type which has a table top with a table top surface, a rotatable circular saw blade that is vertically adjustable relative to the table top, the table top having an opening through which the saw blade can extend, the blade being configured to cut a work piece as the work piece is moved from a forward position to a rearward position, said system comprising:

a riving knife mounted to the saw rearwardly of the blade;

an elongated upper guard barrier releasably connected to said riving knife, said upper guard barrier having a top surface facing away from the table top surface, a bottom surface facing toward the table top surface and outer side surfaces extending between said top and bottom surfaces, said upper guard barrier having an elongated viewing slot substantially coextensive with the blade, with a major portion of a top surface of said upper guard barrier adjacent said viewing slot being downwardly angled toward a center of said viewing slot to enlarge the viewing angle of said blade from above by a user, said bottom surface of said upper guard barrier adjacent said viewing slot extending upwardly away from said viewing slot and the table top surface to deflect work piece cuttings away from said viewing slot;

wherein said viewing slot extends perpendicularly relative to said table top surface between a lower most point of said upwardly extending bottom surface and a lower most point of said downwardly angled top surface of said upper guard barrier.

7. A modular saw guard system as defined in claim 6 wherein said viewing slot extends from a rear portion thereof that connects to said riving knife forwardly to an outer free end of said upper guard barrier.

8. An elongated upper guard barrier designed and configured to be releasably connected to a riving knife attached rearwardly of the blade of a table saw that has a top surface, said upper guard barrier having a top surface facing away from said table saw top surface, a bottom surface facing toward said table saw top surface and outer side surfaces extending between said top and bottom surfaces, said upper guard barrier having an elongated viewing slot substantially coextensive with the blade, with a major portion of said top surface of said upper guard barrier adjacent said viewing slot being downwardly angled toward a center of said viewing slot to enlarge the viewing angle of said blade from above by a user, said bottom surface of said upper guard barrier adjacent said viewing slot extending upwardly away from said viewing slot and the table top surface to deflect work piece cuttings away from said viewing slot;

wherein said viewing slot extends perpendicularly relative to said table top surface between a lower most point of said upwardly extending bottom surface and a lower most point of said downwardly angled top surface of said upper guard barrier.

9. An elongated upper guard barrier as defined in claim 8 wherein said viewing slot extends from a portion that connects to said riving knife forwardly to an outer free end of said upper guard barrier.

* * * * *